United States Patent [19]

Sato et al.

[11] Patent Number: 5,012,622

[45] Date of Patent: May 7, 1991

[54] STRUCTURAL FILLER FILLED STEEL TUBE COLUMN

[75] Inventors: Takanori Sato; Yasushi Watanabe; Seiho Kitagawa; Hideyo Shiokawa; Tomoo Shokawa; Yutaka Saito; Osamu Hosokawa; Takeshi Sano; Kazunori Koshida; Yasukazu Nakamura; Hideo Nakashima; Kenichi Ikeda; Yoshihiro Orito, all of Tokyo, Japan

[73] Assignee: Shimizu Construction Co., Ltd., Tokyo, Japan

[21] Appl. No.: 503,147

[22] Filed: Mar. 30, 1990

Related U.S. Application Data

[63] Continuation of Ser. No. 107,680, Oct. 9, 1987, abandoned, which is a continuation-in-part of Ser. No. 899,549, Aug. 22, 1986, abandoned, which is a continuation-in-part of Ser. No. 847,495, Apr. 3, 1986, abandoned, which is a continuation-in-part of Ser. No. 835,954, Mar. 4, 1986, Pat. No. 4,722,156.

[30] Foreign Application Priority Data

| | | | |
|---|---|---|---|
| Mar. 5, 1985 | [JP] | Japan | 60-42979 |
| Mar. 7, 1985 | [JP] | Japan | 60-45285 |
| Apr. 23, 1985 | [JP] | Japan | 60-87172 |
| Apr. 23, 1985 | [JP] | Japan | 60-87173 |
| Jul. 3, 1985 | [JP] | Japan | 60-146386 |
| Jul. 16, 1985 | [JP] | Japan | 60-156365 |
| Jul. 16, 1985 | [JP] | Japan | 60-156366 |
| Sep. 2, 1985 | [JP] | Japan | 60-193388 |
| Sep. 24, 1985 | [JP] | Japan | 60-210453 |
| Sep. 24, 1985 | [JP] | Japan | 60-210454 |
| Sep. 24, 1985 | [JP] | Japan | 60-210456 |
| Oct. 28, 1985 | [JP] | Japan | 60-241049 |
| Dec. 25, 1985 | [JP] | Japan | 60-295377 |
| Dec. 28, 1985 | [JP] | Japan | 60-299531 |
| Jan. 10, 1986 | [JP] | Japan | 61-3179 |
| Sep. 18, 1987 | [JP] | Japan | 62-234374 |

[51] Int. Cl.[5] ..... E04C 3/34

[52] U.S. Cl. ..... 52/725; 52/263; 52/726

[58] Field of Search ..... 52/725, 726, 724, 263, 52/223, 301

[56] References Cited

U.S. PATENT DOCUMENTS

| | | | |
|---|---|---|---|
| Re. 17,834 | 10/1930 | De Witt | 52/726 |
| 836,673 | 11/1906 | Ford | 52/525 |
| 905,888 | 12/1908 | Lally | 52/301 |
| 960,125 | 5/1910 | Tresidder | 52/301 |
| 1,019,561 | 5/1912 | Tresidder | 52/301 |
| 1,190,002 | 7/1916 | Picuri | 52/725 |
| 1,932,671 | 10/1933 | Pfistershammer | 52/301 |
| 1,971,051 | 8/1934 | Reiner | 52/301 |
| 2,210,553 | 8/1940 | Miller | 52/223 |
| 2,698,519 | 1/1955 | Lloyd | 405/252 |
| 3,058,264 | 10/1962 | Varlonga | 52/236 |
| 3,199,300 | 8/1965 | Fiore | 52/726 |
| 3,382,680 | 5/1968 | Takano | 52/726 |
| 3,501,881 | 3/1970 | Van Buren | 52/223 R |
| 3,793,794 | 2/1974 | Archer | 52/725 |
| 3,828,504 | 8/1974 | Egerborg | 52/722 |
| 3,963,056 | 6/1976 | Shibaya | 405/256 |
| 3,991,532 | 11/1976 | Baxbom | 52/725 |
| 4,272,929 | 6/1981 | Hanson | 52/725 |
| 4,281,487 | 8/1981 | Koller | 52/725 |

FOREIGN PATENT DOCUMENTS

| | | | |
|---|---|---|---|
| 2723534 | 12/1978 | Fed. Rep. of Germany | 52/725 |

*Primary Examiner*—Henry E. Raduazo

*Attorney, Agent, or Firm*—Scully, Scott, Murphy & Presser

[57] ABSTRACT

A concrete filled steel tube column. The concrete filled steel tube column includes a steel tube having an inner face; a concrete core disposed within the steel tube; and a separating layer interposed between the inner face of the steel tube and the concrete core for separating the concrete core from the inner face of the steel tube so that the steel tube may not be bonded to the concrete core. After the separating layer is formed on the inner face of the steel tube, the concrete is charged into the steel tube to form a concrete core.

8 Claims, 27 Drawing Sheets

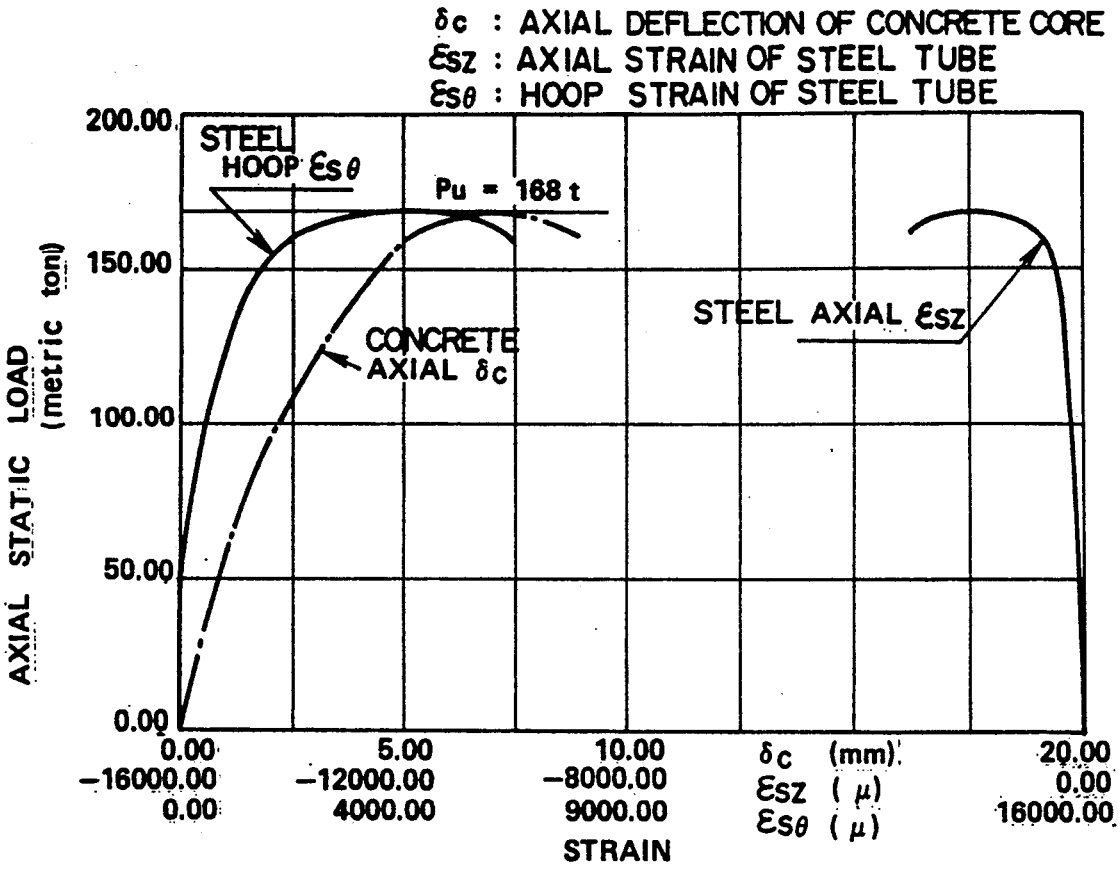
FIG.51 EXAMPL 1
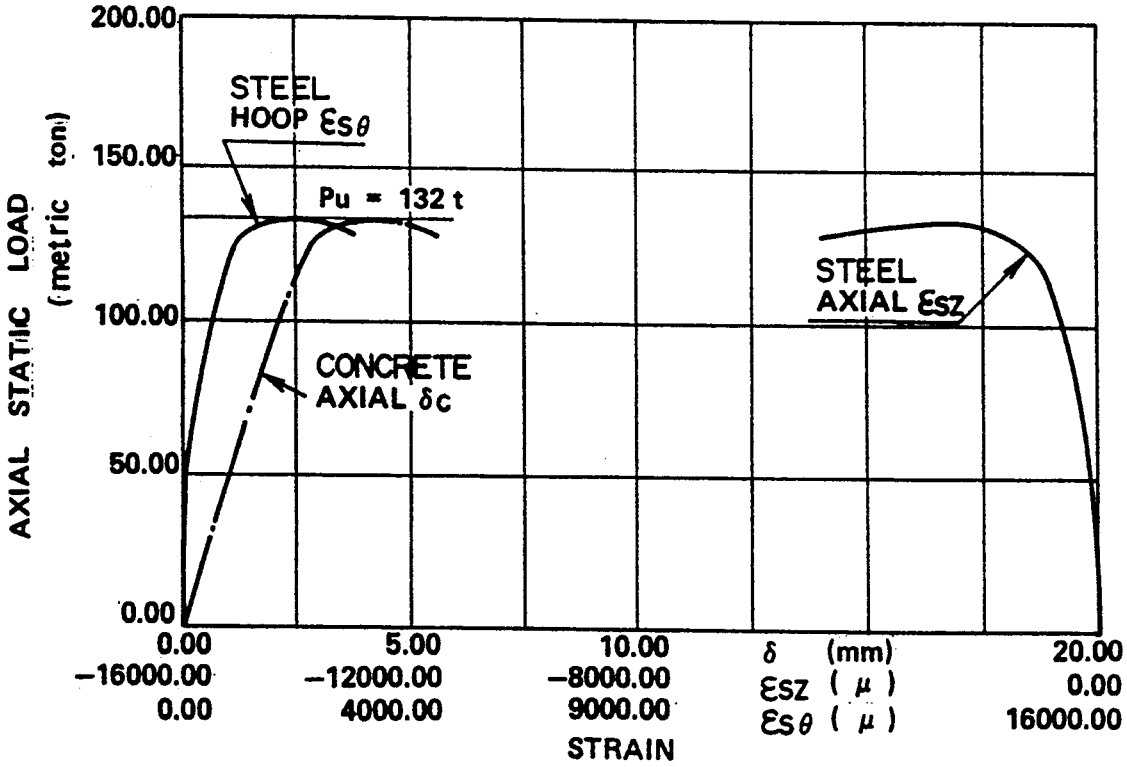
FIG.52 COMPARATIVE TEST

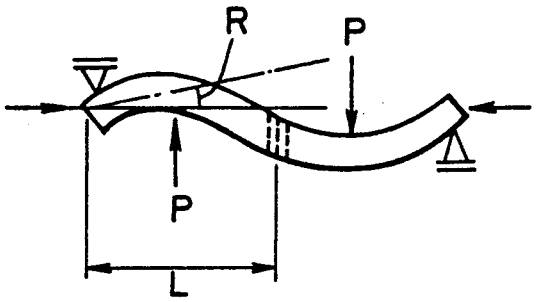
FIG.53
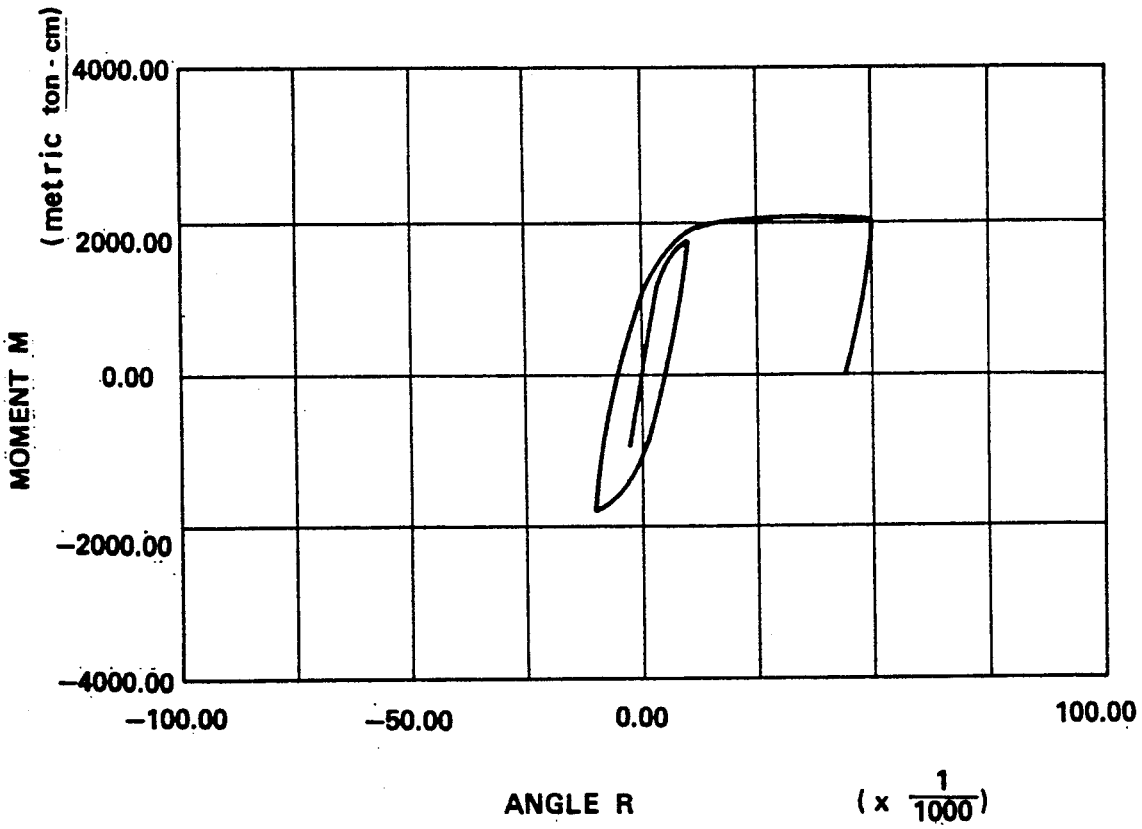
FIG.54 EXAMPLE 2

STRUCTURAL FILLER FILLED STEEL TUBE COLUMN

CROSS REFERENCE TO RELATED APPLICATIONS

This application is a continuation of application Ser. No. 107,680 filed on Oct. 9, 1987, which is a continuation-in-part of application Ser. Nos. 889,549 filed on Aug. 22, 1986, 847,495 filed on Apr. 3, 1986, and 835,954 filed on Mar. 4, 1986. Application Ser. No. 835,954 is now U.S. Pat. No. 4,722,156. Application Ser. Nos. 107,680, 899,549, and 847,495 are now abandoned.

BACKGROUND OF THE INVENTION

The present invention relates to a structural filler filled steel tube column for use in, for example, columns and piles of building structures.

German 18-month Publication No. 2723534 teaches a typical example of the conventional structural filler filled steel tube, in which a steel tube with an inner sliding layer is filled with a structural filler. In this prior art filler filled steel tube, axial load is transmitted from end elements, which are arranged within opposite ends of the steel tube to be axially movable, to the structural filler core and hence the steel tube provides lateral confinement to the structural filler core. However, this structural filler filled tube is not practical as a column of a building structure when beams are welded to the steel tube, since the steel tube is subjected to local buckling by an excess axial load from beams, thus providing insufficient lateral confinement. For a long column for several stories, beams must be welded to the steel tube.

Accordingly, it is an object of the present invention to reduce such drawback of the prior art.

It is another object of the present invention to provide a structural filler filled steel tube column which efficiently enhances the filler core in compression strength to thereby enable a considerable reduction in the cross-section thereof as compared to the prior art column.

SUMMARY OF THE INVENTION

With this and other objects in view, the present invention provides a filler filled steel tube column including: a steel tube having an inner face; a core made from the structural filler disposed within the steel tube; a first separating layer, interposed between the inner face of the steel tube and the core, for separating the core from the inner face of the steel tube so that the steel tube is unbonded to the core; axial stress reducing mechanism disposed at the steel tube and including an annular portion circumferentially extending completely around the steel tube for reducing axial stresses which develop in the steel tube; and axial load transmitting mechanism, mounted to the steel tube, for transmitting an axial load, applied to the steel tube, to the core.

The axial load transmitting means may include an inner flange circumferentially mounted on the inner face of the steel tube to radially inwardly project for transmitting the axial load. With such an inner flange, concrete is uniformly filled with a single tremie and workability in filling concrete is hence enhanced. The inner flange is simple in structure and easy in mounting to the steel tube as compared to other axial load transmitting mechanisms.

The inner flange may be mounted on the inner face of an upper portion of the steel tube.

Preferably, the steel tube includes a tube body and a joint tube concentrically jointed to the tube body, and the inner flange is mounted on an inner face of the joint tube.

The joint tube may have H steel beams jointed to the outer face thereof, each beam having a pair of flange portions and a web portion joining the flange portions, and the joint tube may further have a pair of the inner flanges mounted on the inner face thereof at the same level as corresponding flange portions of the beams. A plurality of first ribs may be mounted on the inner face of the steel tube so that they are jointed to corresponding web portions of the beams through a wall of the steel tube. In the presence of the first ribs, the shearing force from the beams is efficiently transferred to the core and the inner flanges obtain greater strength against an axial force as compared to the axial force transferring mechanism without the ribs.

The inner flange may be mounted on the inner face of the steel tube at an intermediate portion of the steel tube including an inflection point of moment of the steel tube.

Each inner flange is preferably provided with means for preventing air from staying in lower side of the flange when the structural filler is filled into the steel tube. The air stay preventing means prevents any space not filled with concrete from being formed in the core, thus providing predetermined strength to the core.

The air stay preventing means may include an air vent hole formed through the inner flange to extend in an axial direction of the steel tube.

The inner flange may have a plurality of the air vent holes, in which case the air vent holes are circumferentially formed at substantially equal angular intervals.

In another modified form, the inner flange is inclined to a plane perpendicular to an axis of the steel tube to converge toward an upper end of the steel tube. With such a construction, air is prevented to stay below the inner flange and hence any space not filled with the filler is prevented from being formed below the inner flange.

The steel tube may include reinforcing means for reinforcing the inner flange against an axial load applied on the inner flange. In a preferred form, the reinforcing means includes a second rib joining at least one of opposite faces of the flange to the inner face of the steel tube. With the second rib the strength of the flange is enhanced and axial force is hence efficiently transmitted from the second rib to the core.

The steel tube may include means for absorbing an axial strain which develops in the steel tube when the steal tube is subjected to an axial load.

Preferably, the axial strain absorbing means may include a circumferential groove, circumferentially formed in one of both the inner face and the outer face of the steel tube, for absorbing the axial strain of the steel tube by deforming the groove.

In another preferred form, the axial strain absorbing means includes a bead portion radially outwardly protruding from the steel tube by radially outwardly projecting the inner face of the steel tube. The bead portion absorbs the axial strain by axial deformation thereof.

The joint tube may have H steel beams jointed to the outer face thereof, each beam having a pair of flange portions and a web portion joining the flange portions, and the joint tube may further have a pair of the inner flanges mounted on the inner face thereof at the same level as corresponding flange portions of the beams. A plurality of first ribs may be mounted on the inner face of the steel tube so that they are jointed to corresponding web portions of the beams through a wall of the steel tube. In the presence of the first ribs, the shearing force from the beams is efficiently transferred to the core and the inner flanges obtain greater strength against an axial force as compared to the axial force transferring mechanism without the ribs.

The inner flange may be mounted on the inner face of the steel tube at an intermediate portion of the steel tube including an inflection point of moment of the steel tube.

Each inner flange is preferably provided with means for preventing air from staying in lower side of the flange when the structural filler is filled into the steel tube. The air stay preventing means prevents any space not filled with concrete from being formed in the core, thus providing predetermined strength to the core.

The air stay preventing means may include an air vent hole formed through the inner flange to extend in an axial direction of the steel tube.

The inner flange may have a plurality of the air vent holes, in which case the air vent holes are circumferentially formed at substantially equal angular intervals.

In another modified form, the inner flange is inclined to a plane perpendicular to an axis of the steel tube to converge toward an upper end of the steel tube. With such a construction, air is prevented to stay below the inner flange and hence any space not filled with the filler is prevented from being formed below the inner flange.

The steel tube may include reinforcing means for reinforcing the inner flange against an axial load applied on the inner flange. In a preferred form, the reinforcing means includes a second rib joining at least one of opposite faces of the flange to the inner face of the steel tube. With the second rib the strength of the flange is enhanced and axial force is hence efficiently transmitted from the second rib to the core.

The steel tube may include means for absorbing an axial strain which develops in the steel tube when the steal tube is subjected to an axial load.

Preferably, the axial strain absorbing means may include a circumferential groove, circumferentially formed in one of both the inner face and the outer face of the steel tube, for absorbing the axial strain of the steel tube by deforming the groove.

In another preferred form, the axial strain absorbing means includes a bead portion radially outwardly protruding from the steel tube by radially outwardly projecting the inner face of the steel tube. The bead portion absorbs the axial strain by axial deformation thereof.

The steel tube may include a pair of tube pieces coaxially aligned with their adjacent ends spaced apart forming a ring-shaped gap between the adjacent ends of the tube pieces. This gap absorbs the axial strain in the steel tube by reducing its axial width when the steel tube is subjected to an axial compressive load, thereby inhibiting axial strain from being brought into the tube pieces. Thus, in the view of Mieses's yield conditions, lateral confinement of the steel tube which is provided on the core is enhanced.

Preferably, the steel tube includes spacing means, interposed between the adjacent ends of the tube pieces, which retains the gap between the adjacent ends of the tube pieces while allowing the gap to reduce its axial width. The spacing means may be composed of a ring-shaped matrix fitting concentrically into the ring-shaped gap, and an elongated element embedded within the matrix along the circumferential direction of the matrix to form a coil within the matrix.

It is more preferable that the steel tube includes means for coupling the tube pieces coaxially in series while allowing the tube pieces to be axially movable in relation to each other.

The coupling means may be a pipe coupling which fits around both adjacent ends of the tube pieces. The pipe coupling may include, a pipe body defining a space between its inner surface and the tube pieces, an inner layer made of the filler and disposed within the space, and a second separating layer interposed between the inner layer and at least one of the tube pieces.

Otherwise, the coupling means may be a joining tube one end portion of which is coaxially joined to the inner face of one of the tube pieces and the other end portion of which fits coaxially to the inner face of the other tube piece so that the joining tube is axially slidable in relation to the other tube piece. Means for transferring an axial load exerted on one of the tube pieces to said core may be mounted on the joining tube. The load transfer means, preferably, is an inner flange circumferentially joined to one of the opposite ends of the joining tube and projecting radially inwards. It is also preferable that the joining tube has an axially pliant member which is circumferentially disposed on the upper end of the joining tube. This pliant member reduces the axial compressive load exerted from the core to the joining tube.

The steel tube may include fastening means for allowing the tube pieces to approach each other and preventing them from going away from each other. This fastening means may have a pair of outer flanges circumferentially joined to the adjacent ends of the tube pieces respectively, and a plurality of engaging members. The outer flanges project radially outwards and face each other, thus, each of the outer flanges has an inner facing surface and an outer surface. Each of the engaging member has opposite end portions which are in direct contact with the outer surfaces of the outer flanges respectively.

Preferably, the column further includes a joint tube, coaxially mounted to at least one end of the steel tube, for joining beams thereto. The joint tube may have inner circumferential faces tapering toward its axis, and the axial load transmitting means includes the inner circumferential faces. With such a construction, the joint tube prevents air space from being produced under the axial load transmitting means and hence enables concrete placement into the column tube by a single operation. In this joint tube, the axial load from beams is transmitted to the filler core by the wedge effect of axially tapering inner circumferential faces.

The joint tube may have an upper end and a lower end, each end having an inner edge. The joint tube may have a central portion having a thickness larger than the thickness of the steel tube. The circumferential tapering faces may be provided at respective inner edges of upper and lower ends so that the circumferential faces taper upwards at the lower end and downwards at the upper end. Each of the upper end and the lower end may be substantially equal in thickness to the steel tube. This joint tube simplifies the structure of the axial load transmitting means.

BRIEF DESCRIPTION OF THE DRAWINGS

The invention will now be described by way of example with reference to the accompanying drawings in which:

FIG. 51 is a graph showing load-strain characteristic of a concrete filled steel tube column according to the present invention;

FIG. 52 is a graph showing load-strain characteristic of a prior art concrete filled steel tube column;

FIG. 53 is a diagrammatical view of a test piece according to the present invention; and FIG. 54 is a graph illustrating a moment hysteresis loop of the test piece in FIG. 51.

DETAILED DESCRIPTION OF THE PREFERRED EMBODIMENTS

Figure 1:
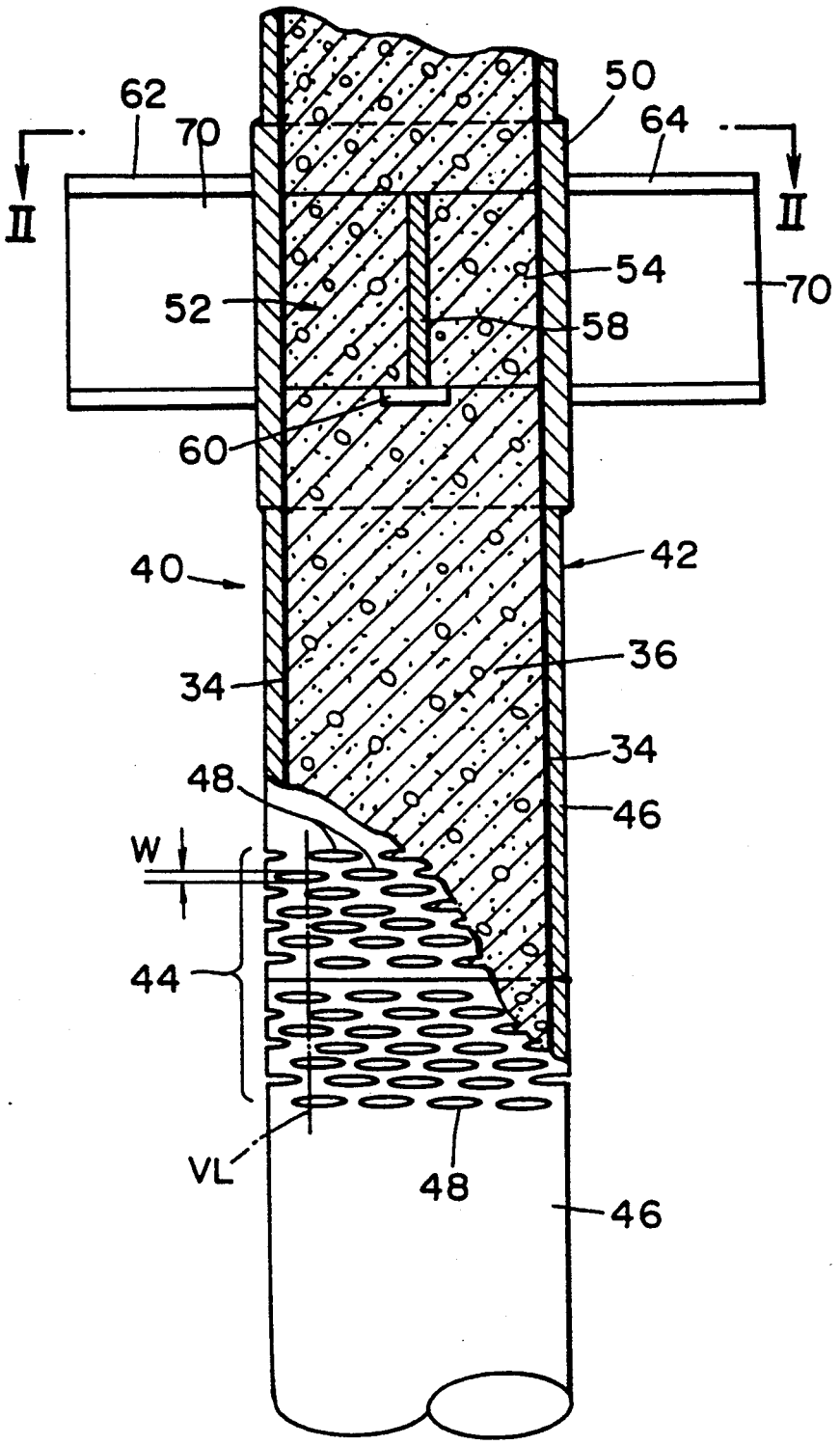
FIG. 1 is a front view, partly in section, of an embodiment of the present invention.

In the drawings, like reference characters designate corresponding parts throughout views, and descriptions of the corresponding parts are omitted after once given.

Figure 2:
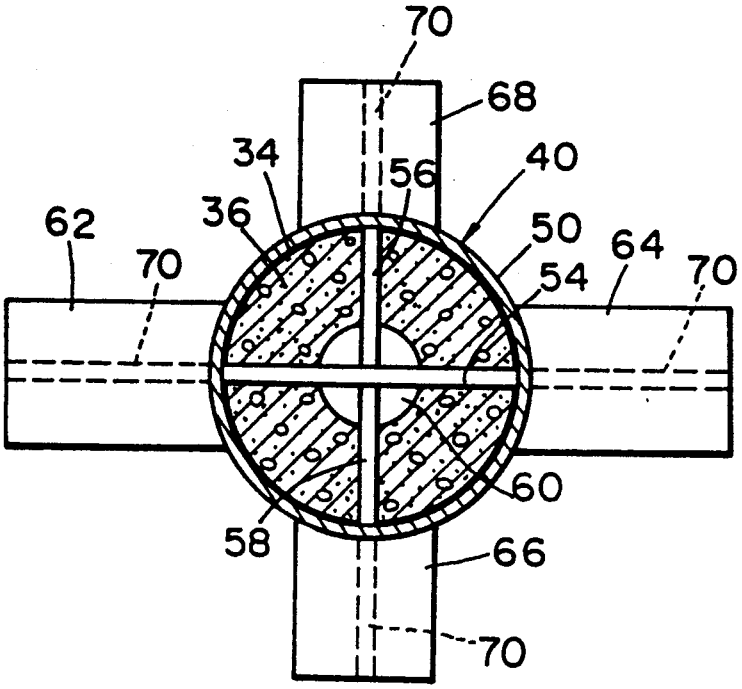
FIG. 2 is a view taken along the line II—II in FIG. 1.

Referring now to FIGS. 1 and 2, reference numeral 40 designates an unbonded, concrete filled steel tube column according to the present invention in which a separating material, asphalt in this embodiment, is applied over the inner face of the steel tube 42 to form a separating layer 34 and then a concrete is filled into it to form a concrete core 36.

In the present invention, steel tubes which are used in the conventional concrete filled steel tube column or steel encased concrete column may be used as the steel tube 42. The steel tube 42 consists of a pair of tube pieces 46 and 46 concentrically welded at one ends thereof and each tube piece 46 is provided at the one end with a seven circumferential rows of slits or through slots 48 in a zigzag manner. Thus, the steel tube 42 is provided at its intermediate portion, i.e., inflection point of moment, with a slit portion 44 having a 14 rows of slits 48. The sum of vertical width W of vertically aligned slits 48 of the slit portion 44 (e.g., the slits 48 on the phantom line VL in FIG. 1) is preferably around a maximum axial strain of the steel tube 42 to be caused by overturning moment of the building. The shape of the slits 48 may be a rectangle, ellipse and like configurations. Instead of slit, through slots and other narrow openings may be formed in the tube. The vertical length of the slit portion 44 is substantially equal to the diameter of the column 40. A paper sheet may be applied to the inner face of the slit portion 44 for preventing mortar from going outside through the slits 48 during placement of concrete into the steel tube 42.

The steel tube 42 has a relatively short joint steel tube 50 concentrically welded at the other end. The joint tube 50 has a load transfer assembly 52 welded to its inner face. The load transfer assembly 52 includes a web 54 and webs 56 and 58 perpendicularly welded to the web 54 to form a cross shape as shown in FIG. 2. The load transfer assembly 52 has a bearing disc member 60 welded to its lower edges to be concentric with the joint tube 50. Also, the joint tube 50 is coated over its inner face with the separating layer 34 and is charged with the concrete. Another steel tube is concentrically welded to the upper edge of the joint tube 50. The joint tube 50 is welded at its outer face to one ends of four H steel beam joint members 62, 64, 66 and 68 so that the beam joint members are disposed in a horizontal plane with adjacent beam joint members forming a right angle. Webs 70 of the beam joint members 62, 64, 66 and 68 are jointed at their one ends via the wall of the joint tube 50 to corresponding outer ends of the webs 54, 56 and 58 of the load transfer assembly 52. The other end of each of the beam joint member 62, 64, 66 and 68 is welded to a beam not shown.

The separating layer 34 serves to separate the inner faces of the steel tube 42 from the concrete core 36 so that the concrete core 36 is unbonded to the steel tube 42. The separating material used in the present invention may include, for example, a grease, paraffin wax, synthetic resin, paper and a like material other than asphalt. The thickness of the separating layer 34 is preferably such that it provides a viscous slip to the concrete core 36. When asphalt is used, the thickness of the separating layer 34 is typically about 20–100 um.

With such a construction, shearing force from the beams which are jointed to the joint members 62 and 64 is transferred via the beam joint members 62 and 64 and the wall of the joint tube 50 to the webs 54 of the load transfer assembly 52 and on the other hand shearing force from the beams which are jointed to the beam joint members 66 and 68 is transferred via the joint members 66 and 68 and the wall of the joint tube 50 to respective webs 58 and 56 of the load transfer assembly 52. Then, the shearing force is transferred by means of the bearing disc member 60 to the concrete core 36 as an axial force. Thus, the steel tube 42 is subjected to a rather smaller axial force from the beams than the concrete core 36. In the presence of the separating layer 34, the steel tube 42 and the joint tube 50 are axially movable relative to the concrete core 36 and hence when the concrete core 36 undergoes axial compression, the steel tube 42 follows the concrete core 36 with a much smaller degree of axial strain than the prior art steel tube bonded to its concrete core. Further, the axial compression of the steel tube 42 reduces its axial length by axially deforming the slits 48 of the slit portion 44, thus dissipating the axial stress in the steel tube 42 and the joint tube 50. In view of the of Mieses's yield conditions, strength of the steel tube 42 and the joint tube 50 against circumferential stress which develops in them due to a transverse strain of the concrete core 36 increases, thus enhancing confinement effect of the steel tube 42 which is provided to the concrete core 4. The column 40 insures higher compression strength than the column 30 of the preceding embodiment.

According to the present invention, the concrete may include, for example, an ordinary concrete, lightweight concrete, fiber concrete, etc. In place of the concrete, a mortar, sand, glass particles, metal powder, synthetic resin and like structural filler materials may be used.

Figure 4:
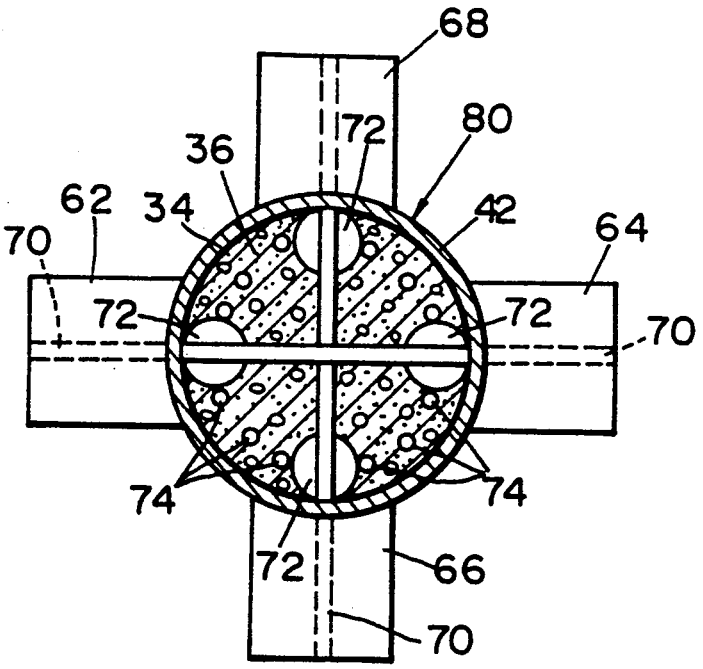
FIG. 4 is a view taken along the line IV—IV in FIG. 3.
Figure 3:
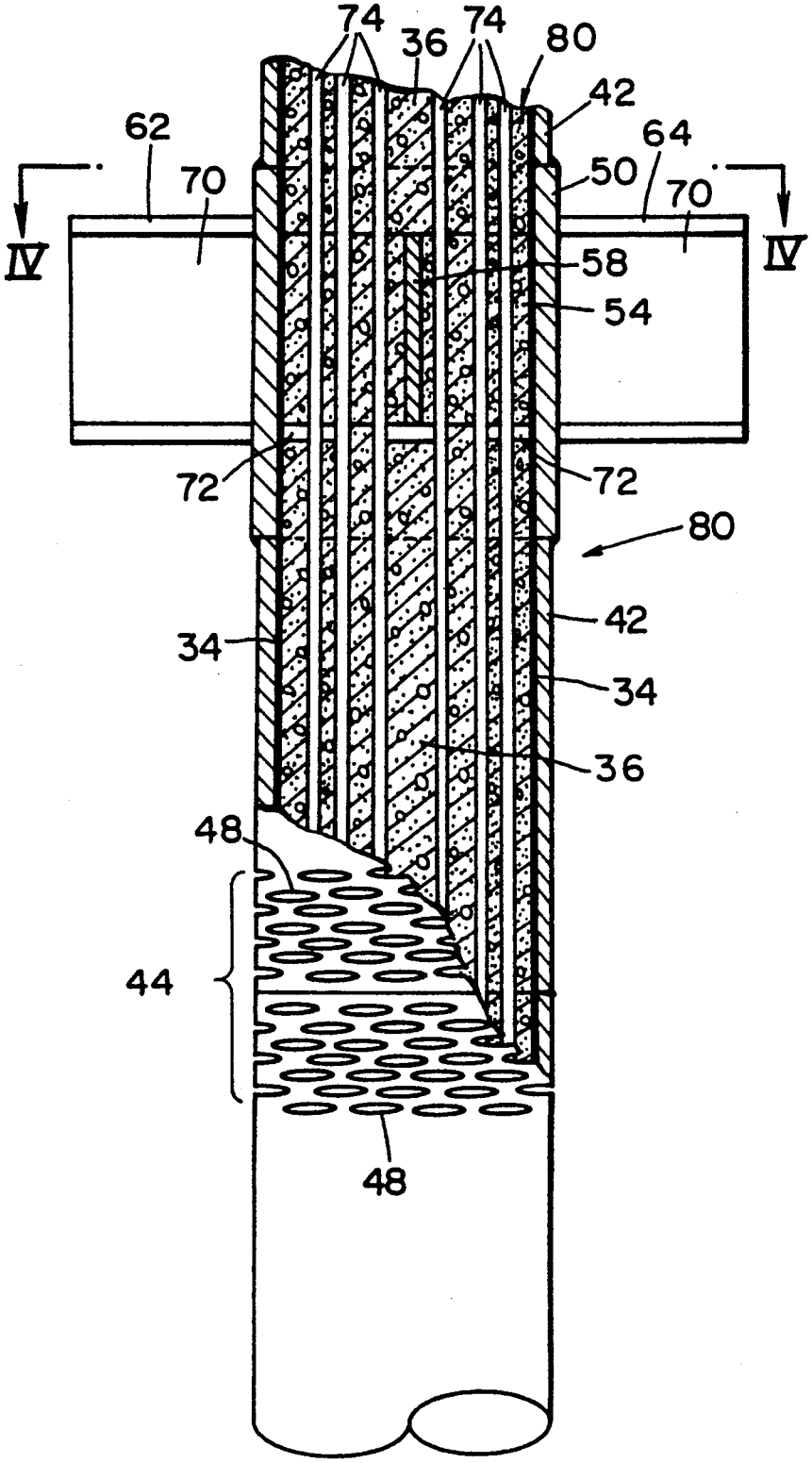
FIG. 3 is a front view, partly in section, of a modified form of the concrete filled steel tube column in FIG. 1.

A modified form of the embodiment in FIGS. 1 and 2 is illustrated in FIGS. 3 and 4, in which four bearing discs 72 are welded to lower edges of the webs 54, 56 and 58 of the load transfer assembly 52 to be disposed in a horizontal plane at 90° angular intervals as shown in FIG. 4. In this modification, a plurality of reinforcements 74 are axially disposed within the steel tube 42 and the joint tube 50 at angular intervals about the axis thereof. After the reinforcements 74 are disposed in such a manner, a concrete is charged into the joint tube 50 and the steel tube 42 in a conventional manner. A large proportion of shearing force from beam joint member 62, 64, 66 or 68 is transferred via the four bearing discs 72 to the concrete core 36. In the presence of the reinforcements 74, the column 80 has large strength as compared to the column 40 in FIGS. 1 and 2. Such reinforcements 74 may be disposed within the columns in FIGS. 1–2.

Figure 5:
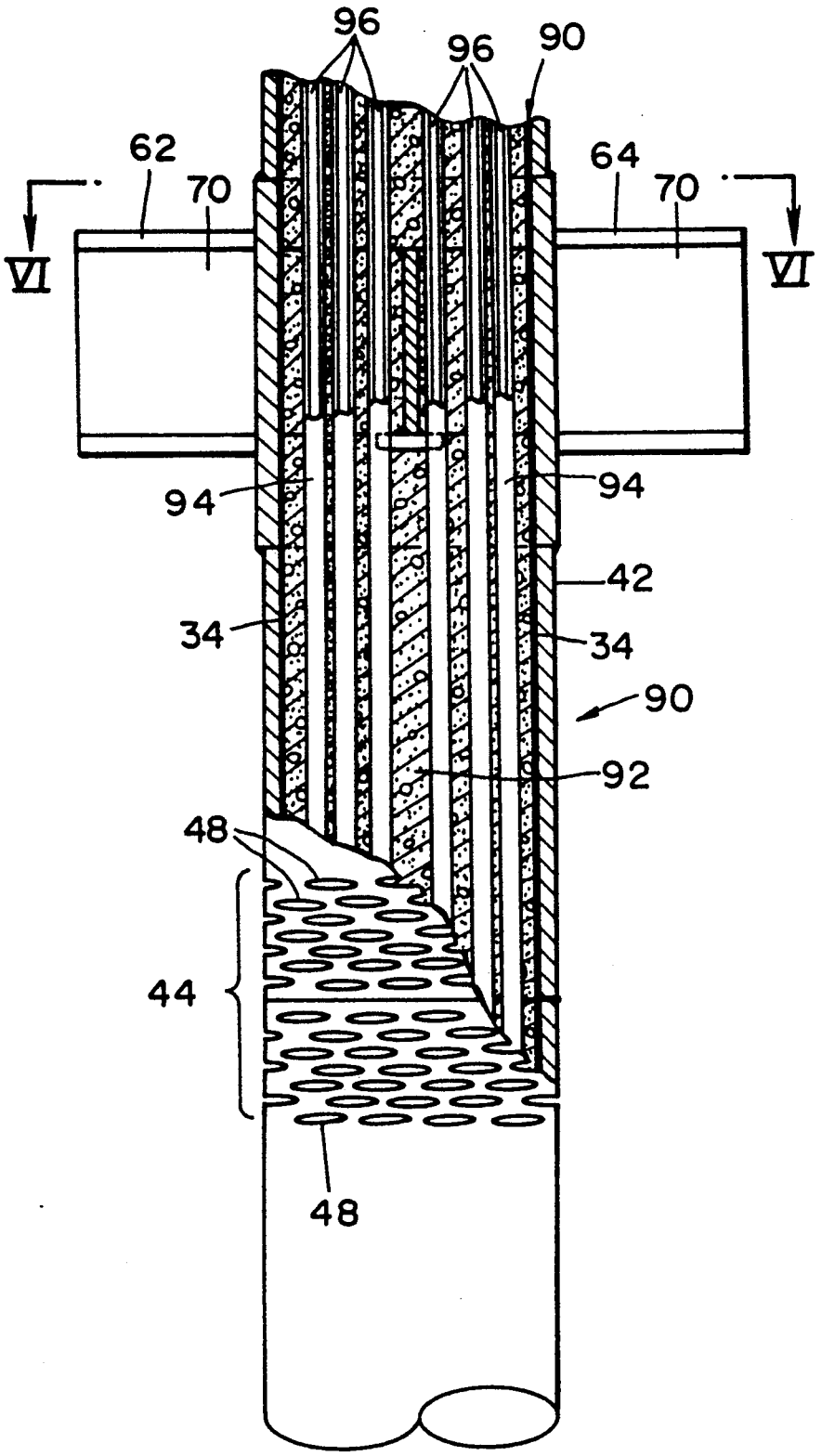
FIG. 5 is another modified form of the concrete filled steel tube column in FIG. 1.
Figure 6:
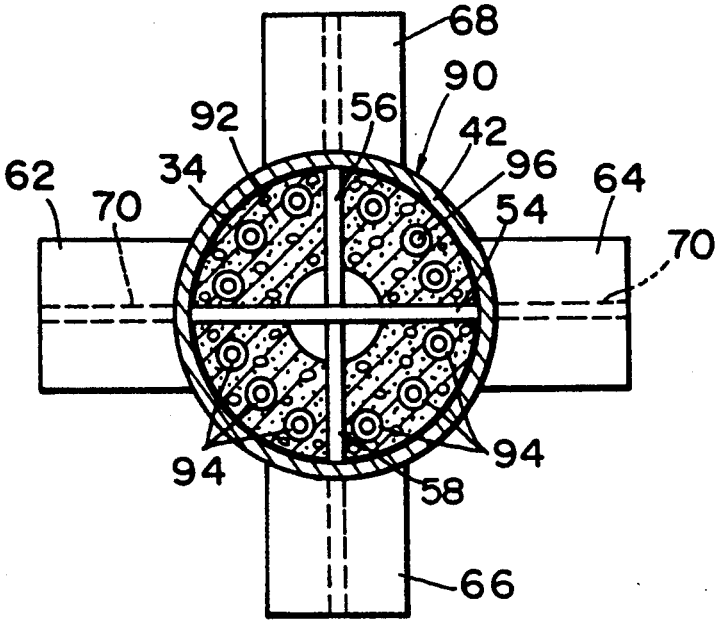
FIG. 6 is a view taken along the line VI—VI in FIG. 5.

A still modified form of the column 40 in FIGS. 1 and 2 is shown in FIGS. 5 and 6, in which a column 90 contains a prestressed concrete core 92. A plurality of, twelve in this modification, sheath pipes 94 are axially disposed within the steel tube 42 at substantially equal angular intervals about the axis thereof as shown in FIGS. 5 and 6. Each sheath pipe 94 has a PC steel rod 96 passed through it. After the concrete is set, a tension is conventionally applied to each PC steel rod 96. The sheath pipes 94 and PC rods 96 may be provided to the column 80 in FIGS. 3 and 4 instead of the reinforcements 74.

Figure 7:
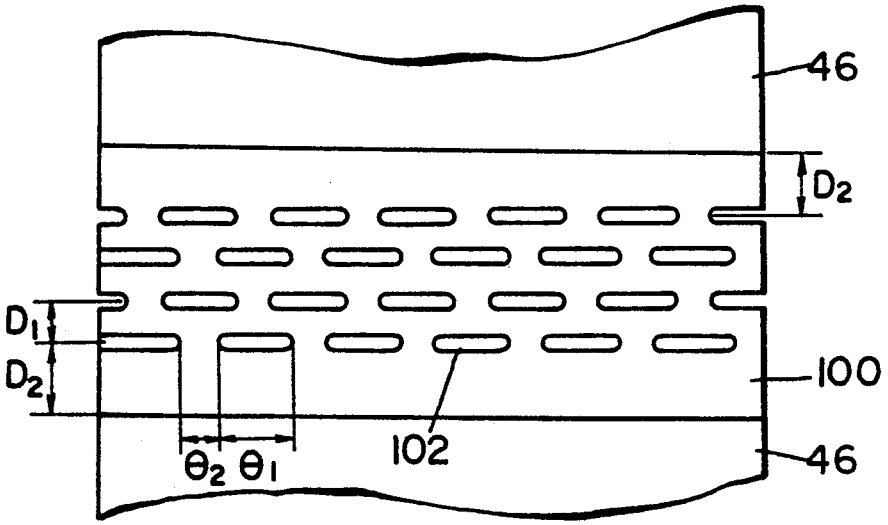
FIG. 7 is a partial view of a modified form of the concrete filled steel tube column in FIG. 1.

A modified form of the slit steel tube 42 is shown in FIG. 7, in which a sliced slit tube 100, having four rows of slits 102 formed through it, is coaxially welded at its opposite ends with a pair of tube pieces 46.

Figure 8:
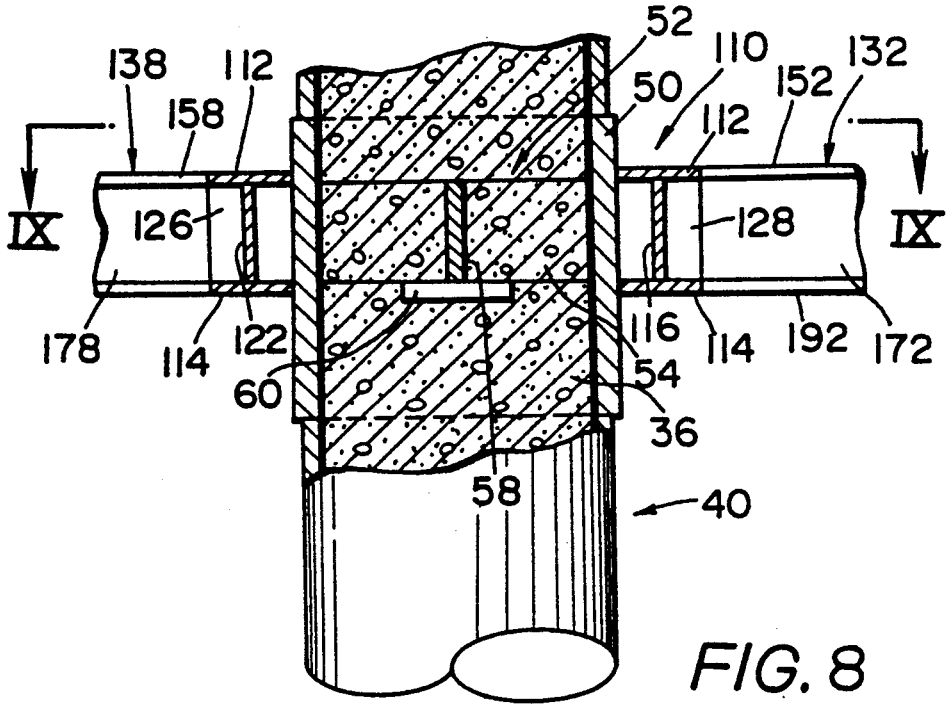
FIG. 8 is a front view, partly in section, of a still other modified form of the concrete filled steel tube column in FIG. 1.
Figure 9:
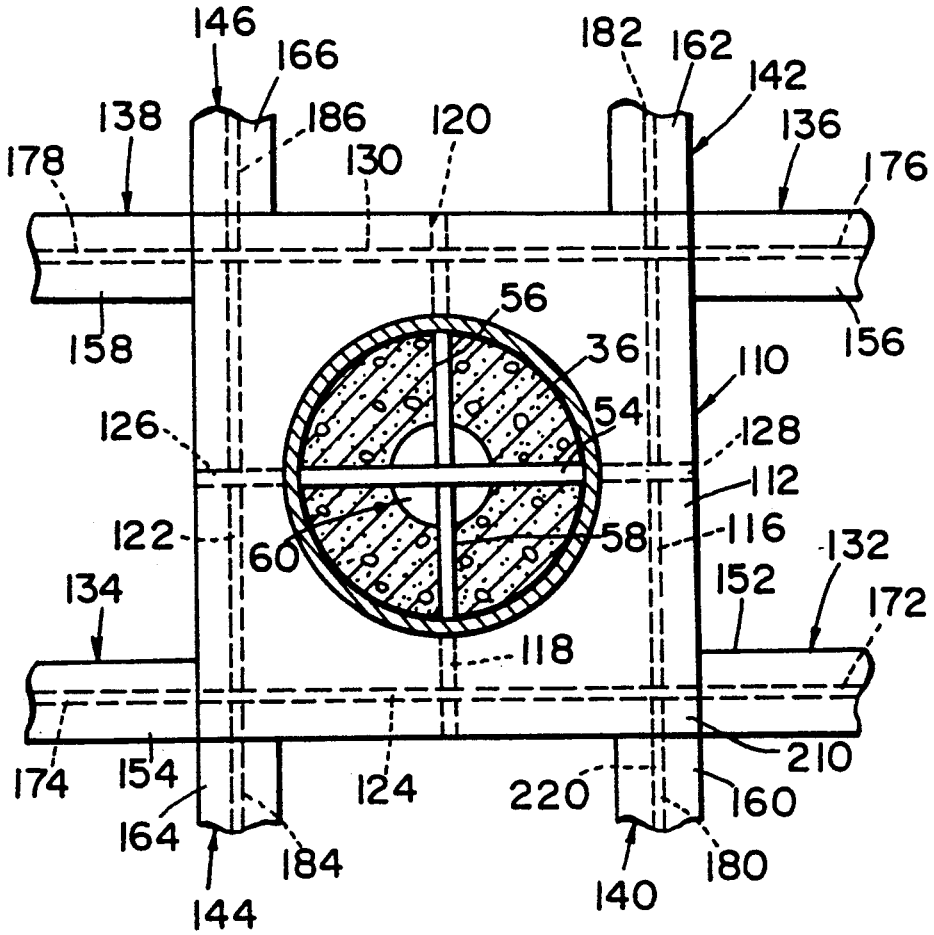
FIG. 9 is a view taken along the line IX—IX in FIG. 8.

FIGS. 8 and 9 illustrate another modified form of the concrete column in FIGS. 1 and 2, from which this modification is distinct in the joint structure of the joint tube 50 to beams. The joint tube 50 has a beam joint assembly welded around it. The joint assembly 110 includes a pair of parallel flanges 112 and 114 fitted around and welded to the joint tube 50. The flanges 112 and 114 are jointed by means of ribs 116–130. The ribs 116–130 and the outer wall of the joint tube 50 define four separate spaces. The inner ends of the ribs 118, 120, 126 and 128 are welded through the wall of the joint tube 50 to the outer ends of the webs 54, 56 and 58 of the load transfer assembly 52. Each corner of the joint assembly 110 is jointed to ends of two perpendicular H steel beams 132 and 140, 134 and 144, 136 and 142 or 138 and 146. More specifically, with respect to the beam 132, one end of its upper flange 152 is welded to the one edge of the upper flange 112 at one corner 210, one end of the web 172 to one end of the rib 124 and one end of the lower flange 192 to one edge of the lower flange 114 at the one corner 210. On the other hand, the beam 140 has an upper flange 160 welded at its one end to the other edge of the upper flange 112 at the one corner 210, a web 180 welded at its one end to one end of the web 116, and a lower flange 220 welded at its one end to the other edge of the lower flange 114 at the one corner 210. In the same manner, the other beams 134–138 and 142–146 are jointed to the other corners of the upper and lower flanges 112 and 114 of the flange assembly 110.

With such a construction, a shearing force exerted on the beams 132 and 134, mainly on the webs 172 and 174 thereof is transferred via ribs 124 to the web 118, from which it is transferred via the joint tube 50 and the web 58 to the bearing disc 60, which in turn transfers the force as an axial force to the concrete corer 36. The beams 136 and 138 transfer a shearing force, which is exerted on them, via ribs 130 and 120, the joint tube 50 and the web 56 to the bearing disc 60. The beams 140 and 142 transfer a shearing force exerted on them via ribs 116 and 128, the joint tube 50 and the web 54 to the bearing disc 60. Lastly, a shearing force exerted on the beams 144 and 146 is transferred via the ribs 122 and 126, the joint tube 50 and the web 54 to the bearing disc 60.

In this modification, the beams 132–146 are jointed 30 through the joint assembly 110 to the column 40 and hence this beam and column joint structure is longer in web length than the beam and column joint structure in the preceding embodiments. Thus, the beams 132–146 are capable of deflecting in a lager degree and hence this modified form has a more flexible column and beam joint structure than the preceding embodiments. This joint structure may be adopted in the embodiments in FIGS. 1–6.

Figure 10:
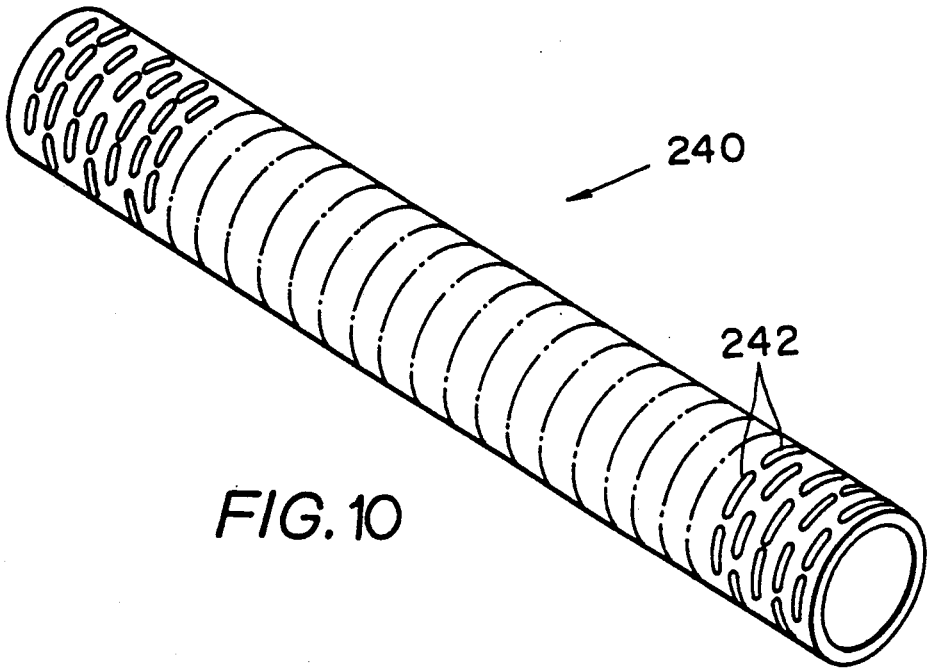
FIG. 10 is a perspective view of a slit tube.
Figure 11:
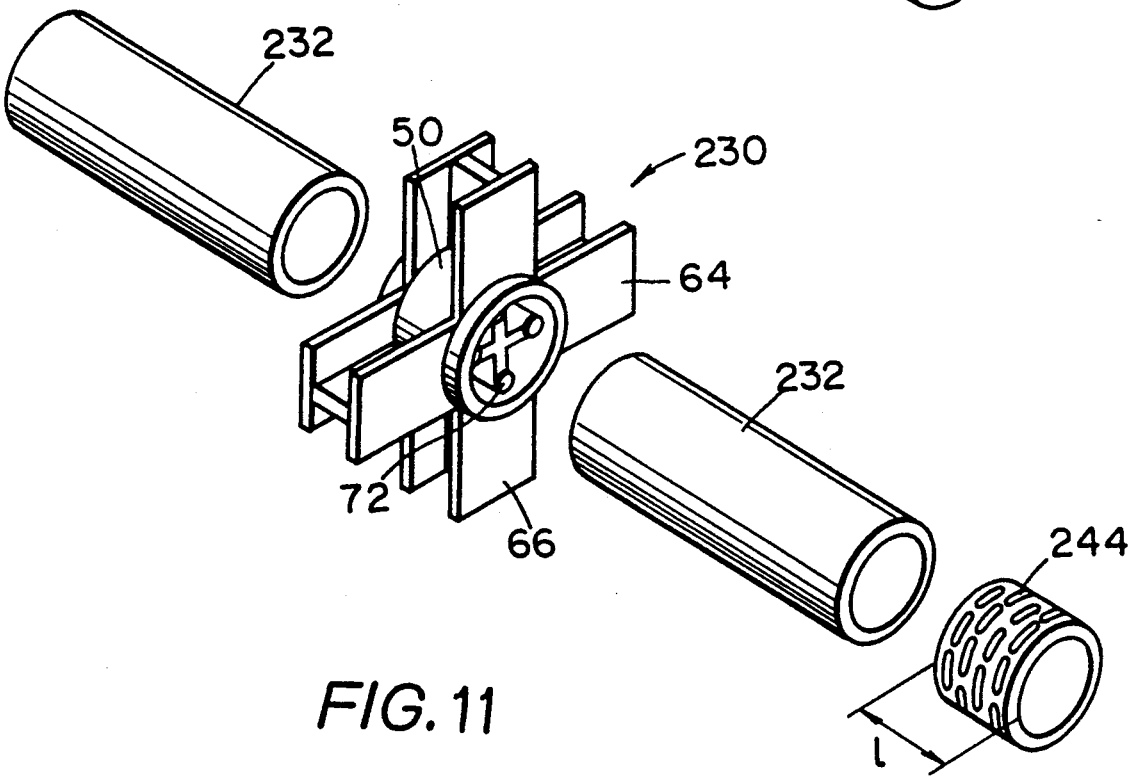
FIG. 11 is an exploded view of a steel tube used in a modified form of the concrete filled steel tube column in FIG. 1.
Figure 12:
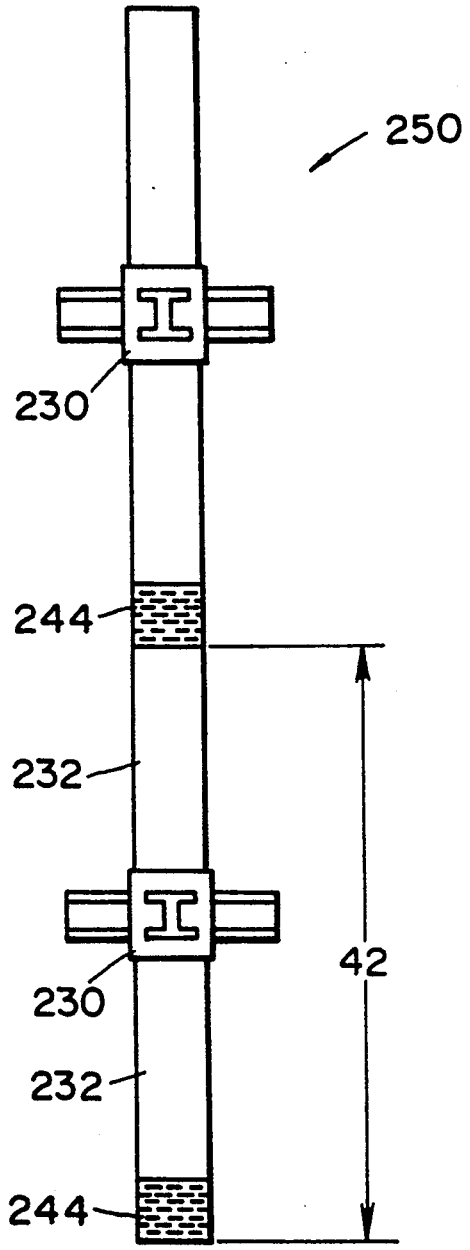
FIGS. 12 to 15 illustrate a process of constructing a building framework using the steel tube in FIG. 11.
Figure 13:
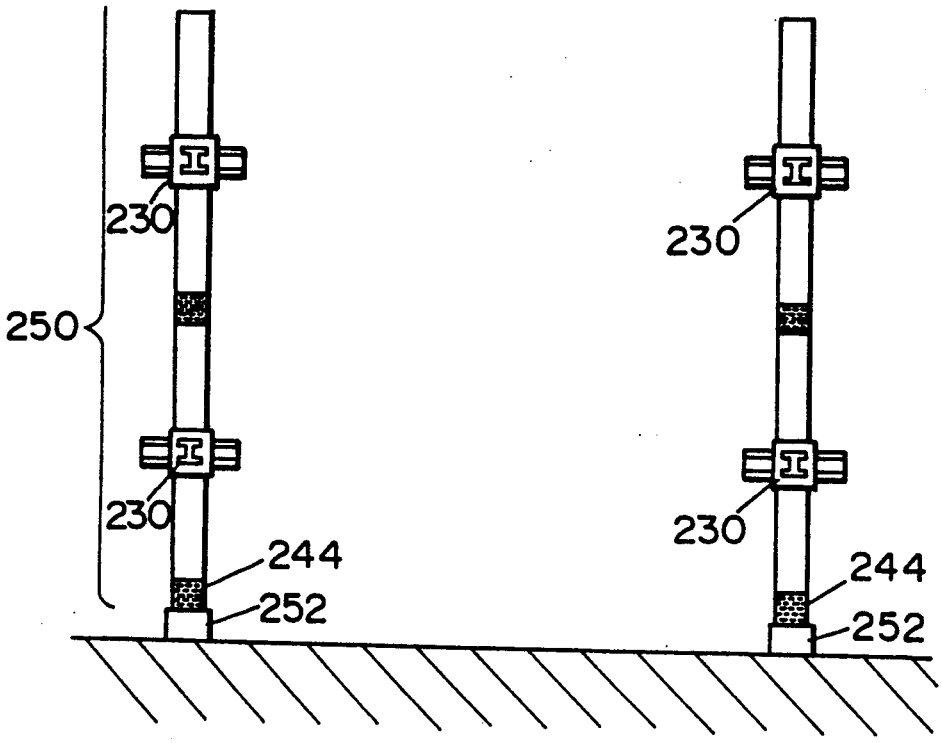

FIGS. 10–15 illustrate a process for fabricating a modified form of the column 40 in FIGS. 1 and 2. First of all, a joint tube assembly 230 as shown in FIGS. 3 and 4 is prepared. The joint tube 50 of the joint tube assembly 230 is welded at each of its opposite ends to a tube body 232. On the other hand, a slit steel tube 240 which has a large number of slits 242 formed through it over the whole area thereof is prepared as illustrated in FIG. 10. The slit steel tube 240 may be produced by centrifugal casting or by forming slits through a conventional steel tube with a water jet, a high speed cutter, gas torch, etc. The slit tube 240 thus prepared is sliced into many slit pieces 244 having a length of 1. One slit piece 244 is concentrically welded to the free end of one tube body 232 welded to the joint tube 50, the tube body 232 having a longer length than the slit piece 244. Thus, there is prepared a steel tube 42 with the joint assembly 230 as indicated in FIG. 12. A plurality of, two in this embodiment, steel tubes 42 are welded in series as illustrated in FIG. 12 to form a jointed tube unit 250. Thereafter, a separting layer is applied over the inner face of the jointed tube unit 250 so that the jointed tubes 232, 50 and 244 may not be bonded to a concrete core to be disposed within them. The separating layer is formed by applying a separating material such as a grease, paraffin wax, asphalt and a like material or depositing a plastic film on the inner face of the jointed tubes. This separating layer forming process may be carried out before a plurality of steel tubes are welded.

Figure 14:
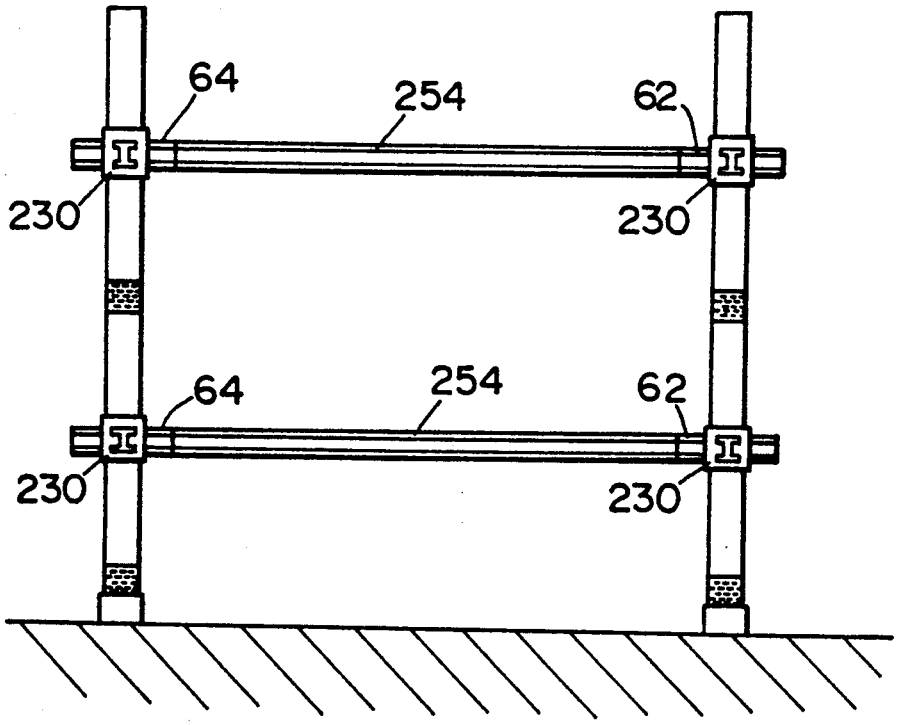
Figure 15:
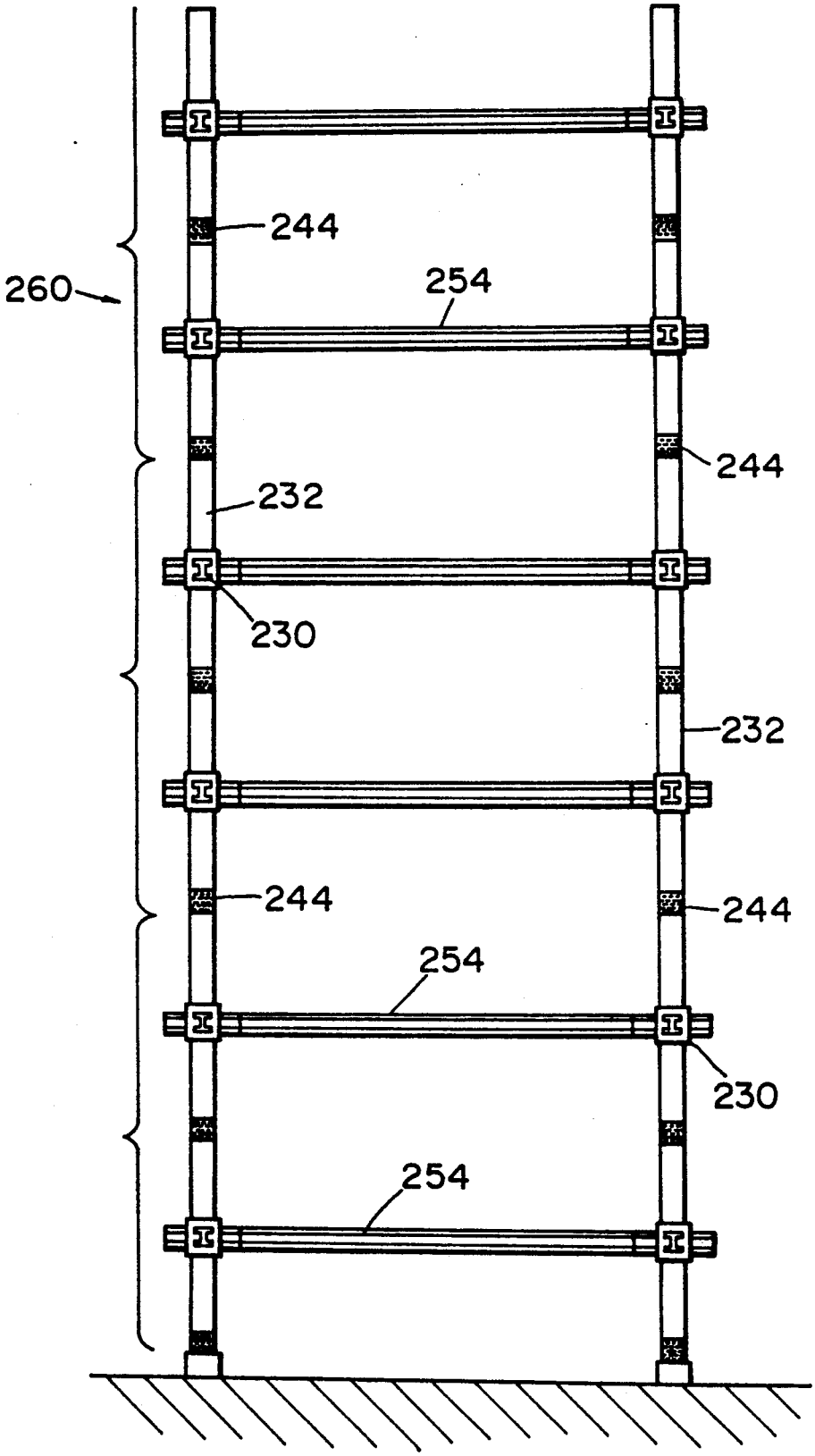

In constructing a building framework, a plurality of the joint tube units 250 above described are prepared. Joint tube units 250 for the first or ground floor are erected by means of a crane on bases 252, in which event a slit piece 244 welded to one end of each jointed tube unit 250 is placed on a corresponding base 252. Adjacent two tube units 250 erected are spanned with two beams 254 and 254 which are welded or jointed by bolts at their opposite ends to respective opposing beam joint members 62 and 64 of the corresponding joint assembly 230 of the tube units 250 as shown in FIG. 14. At this stage of the construction, reinforcements may be disposed as shown in FIGS. 3 and 4 if needed. Then, a concrete is charged into the tube unit 250 and cured. Then, tube units 250 for the next floor are welded at their slit parts 244 to the upper ends of corresponding tube units 250 already erected as shown in FIG. 15. By repeating the above-described procedures, a more than two story building framework 260 is constructed as illustrated.

In this construction process, each tube unit 250 has two steel tubes 42 each having joint assembly 230 but it may use the steel tube 42 in number of one or more than two. Before beams 254 are welded to the tube units 250, more than two tube units may be jointed in series.

Although in the preceding embodiments, slits are partially formed in steel tubes 42, slits may be formed to distribute in the overall face thereof as illustrated in FIG. 10. Before assembling, the steel tube 42 may be axially stretched to have a longer length. By doing so, the steel tube unit 250 is subjected to a less axial strain when the concrete core is compressed. In this case, before stretching, the steel tube 42 is provided with circumferential slits which are deformed into wider slits 242 when axially stretched.

Figure 16:
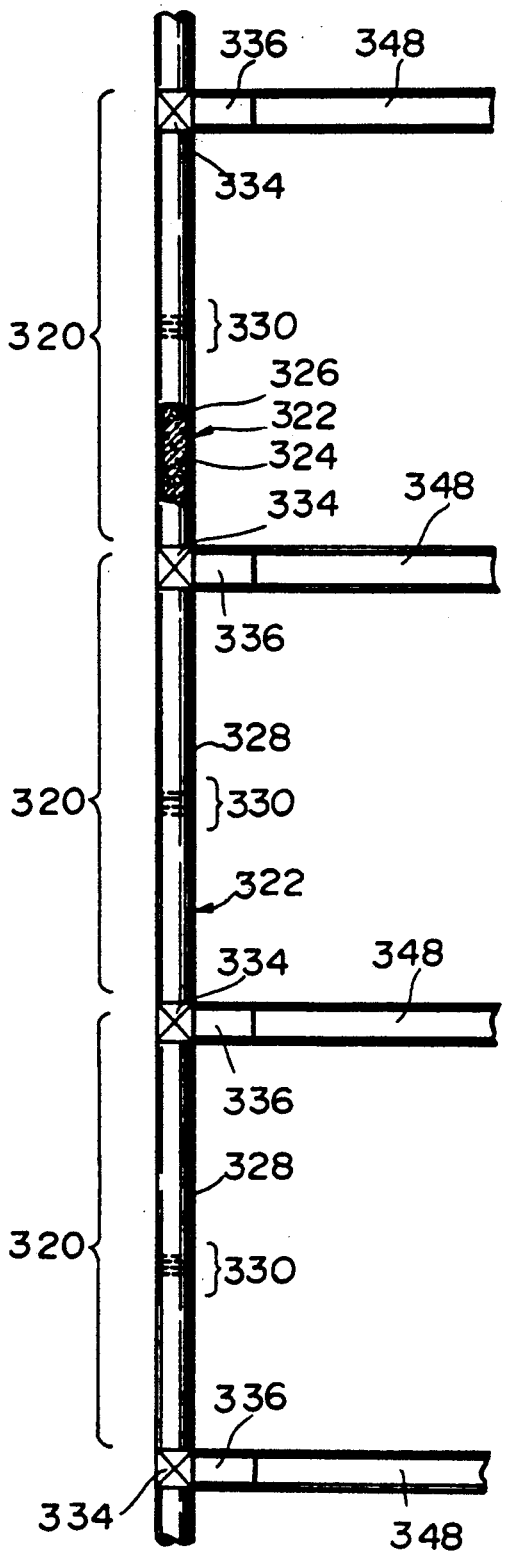
FIG. 16 is a partial view partially cutaway of a building framework having a plurality of structural filler filled steel tube columns in a modified form of the column in FIG. 1.

FIG. 16 illustrates a part of a building framework, which has a plurality of steel tube columns 320 in a modified form of the column in FIG. 1, the columns 320 being concentrically jointed in series. Each column 320 includes a steel tube 322 coated over its inner face **322*a* with a separating layer 324 and a core 326 disposed within the steel tube 322. The thickness of the steel tube 322 is in the range of 1/500 to 1/10 of the outer diameter of the steel tube 322. The separating layer 324 may be made of a separating material, such as asphalt, grease, paraffin wax, synthetic resin and paper. The core 326 is made of a structural filler, such as concrete, mortar, sand, glass particles, metal powder, and synthetic resin. The separate layer 324 serves to separate the steel tube 322 from the core 326 so that the core 326 is not bonded to the steel tube 322**.

Figure 17:
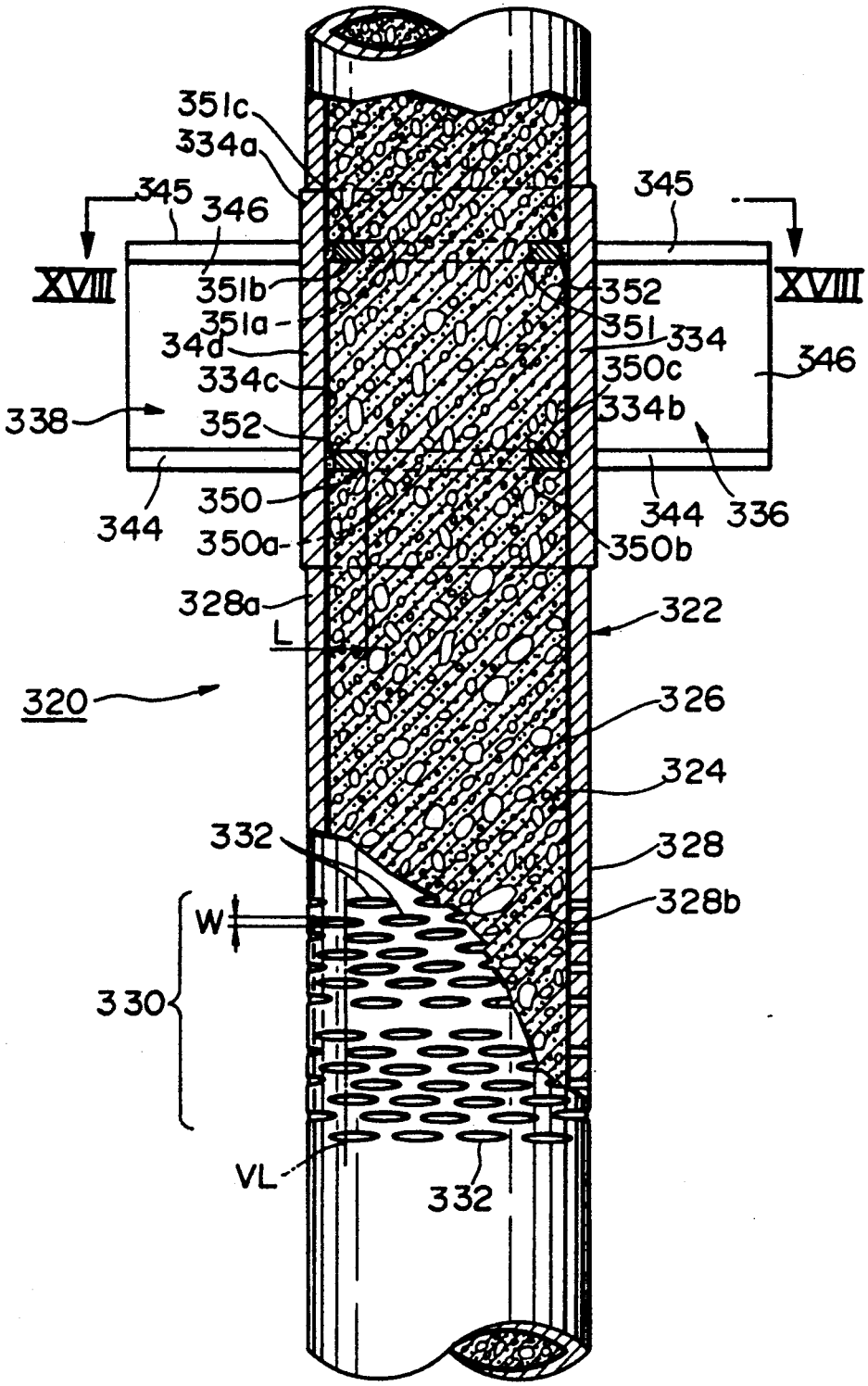
FIG. 17 is an enlarged fragmentary front view, partly in section, of the steel tube column in FIG. 16.

In this embodiment, the steel tube 322 has a tube body 328 which is provided at its intermediate portion, i.e., inflection point of moment, with a through slot portion 330 having a plurality of rows of through slots 332. As shown in FIG. 17, the through slots 332 are circumferentially formed in the through slot portion 330 at equal spacings, and adjacent through slots 332 of the adjacent two rows are shifted in their positions in a zigzag manner. The sum of vertical width W of vertically aligned through slots 332 of the through slot portion 330 (e.g., the through slots 332 on the phantom line VL in FIG. 17) is preferably in the range of a maximum axial strain of the steel tube 322 which is caused by overturning moment of the building. Instead of the through slots 332, slits may be formed in the tube body 328.

The steel tube 322 also has a relatively short joint tube 334 concentrically welded to upper end **328*a* of the tube body 328. To the upper edge 334*a* of the joint tube 334, another steel tube is concentrically welded at its lower end. The joint tube 334 is welded at its outer face 334***b* to the inner ends of four H steel beam joint members 336, 338, 340 and 342 (see FIG. 18) so that the beam joint members are disposed in a horizontal plane with adjacent beam members forming a right angle. Each of the beam joint members 336, 338, 340 and 342 has a pair of flange portions 344 and 345 and a web portion 346 which joints the flange portions 344 and 345. The outer end of each of beam joint members 336, 338, 340 and 342 is welded to a beam 348 shown in FIG. 16. The joint tube 334 has a pair of inner flanges 350 and 351 circumferentially welded to the inner face 334*c* thereof at the same level as corresponding flange portions 344 and 345 of the beam joint members 336, 338, 340 and 342. The inner flanges 350 and 351 project radially inwardly into the core 326. The radial length L of each inner flange is in the range of 1/40 to 1/5 of the outer diameter of the joint tube 334. In this embodiment, each of the inner flanges 350 and 351 has a plurality of air vent holes 352. The vent holes 352 extend in an axial direction of the steel tube 322 and are circumferentially formed at substantially equal angular intervals. The inner diameter of each bent hole 352 is large enough to allow water and mortar to go through it. The thickness of the inner flanges 350 and 352, number and diameter of the bent holes 352 are preferably designed to provide them with enough strength to transfer an axial force from the steel tube 322 to the core 326 even when the maximum axial strain is generated in the steel tube 322.

In this construction, shearing force from the beams 348 is transferred via the beam joint members 336, 338, 340 and 342 and via the wall of the joint tube 334 to the inner flanges 350 and 351. Then, the shearing force is transferred from the inner flanges 350 and 351 to the core 326 as an axial force. Thus, the steel tube 322 is subjected to a rather smaller axial force from the beams 348 than the core 326. In the presence of the separating layer 324, the steel tube 322 is axially movable relative to the core 326 and hence when the core 326 undergoes axial compression, the steel tube 322 follows the core 326 with a much smaller degree of axial strain than the prior art steel tube bonded to its concrete core. Furthermore, the axial compression of the steel tube 322 reduces its axial length by axially deforming the through slots 332 of the through slot portion 330, thus dissipating the axial stress in the steel tube 322.

Figure 19:
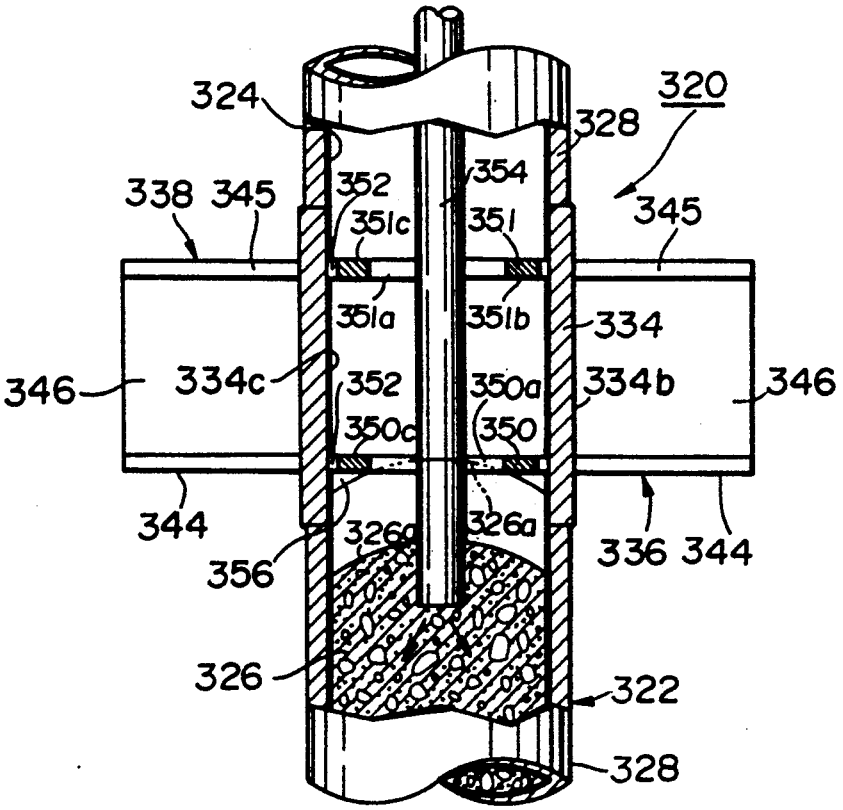
FIG. 19 is a partial view partly in section of the steel tube column in FIG. 17, illustrating filling of a steel tube with concrete by means of a tremie.

In constructing the above described steel tube column 320, a structural filler, for example concrete, is filled into the steel tube 322 to form the core 326 by using, for example, a tremie which conveys concrete. In this filling process, the inner flanges 350 and 351 enable a tremie 354 to be inserted into the steel tube 322 along the axis thereof by allowing the tremie 354 to pass through the center openings 350*a* and 351*a* of corresponding inner flanges 350 and 351 as illustrated in FIG. 19. Thus, the concrete 326 is supplied to the center of the steel tube 322 and evenly distributed over the whole cross-sectional area of the steel tube 322. When the top face of the concrete 326 approaches from a level shown by the solid line in FIG. 19 to the phantom line, air goes through the center opening 350*a* of the flange 350 and vent holes 352, so that the ring shaped air space 356 under the inner flange 350 is filled with the concrete 326 and thus the vent holes 352 and the center opening 350*a* of the inner flange 350 are also filled with the concrete. Air space is prevented from staying in the lower side 351*b* of the flange 351 in the same manner. As a result, a steel tube column having the joint portion with no air space not occupied with concrete is constructed.

Figure 18:
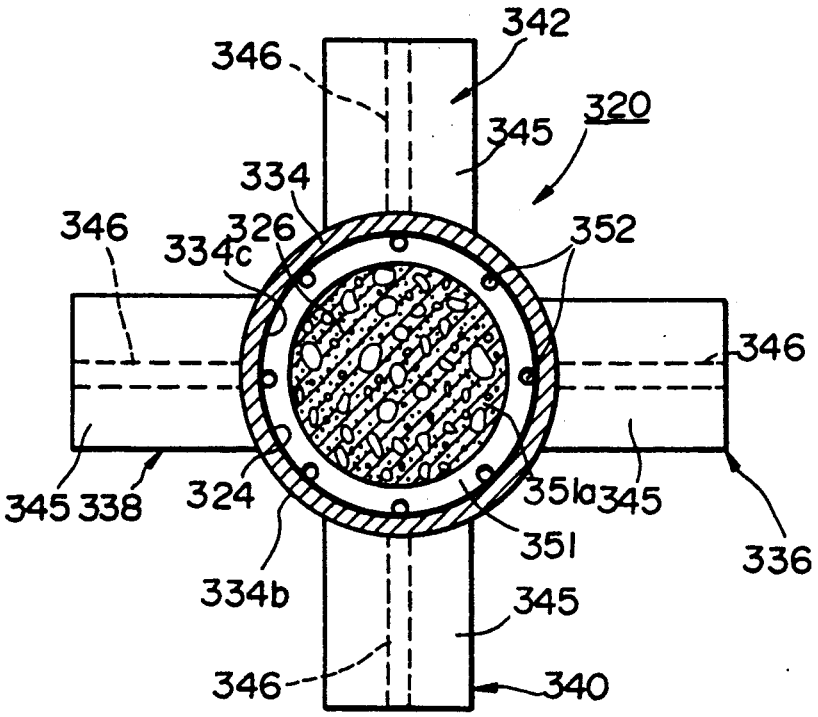
FIG. 18 is a view taken along the line XVIII—XVIII in FIG. 17.
Figure 20:
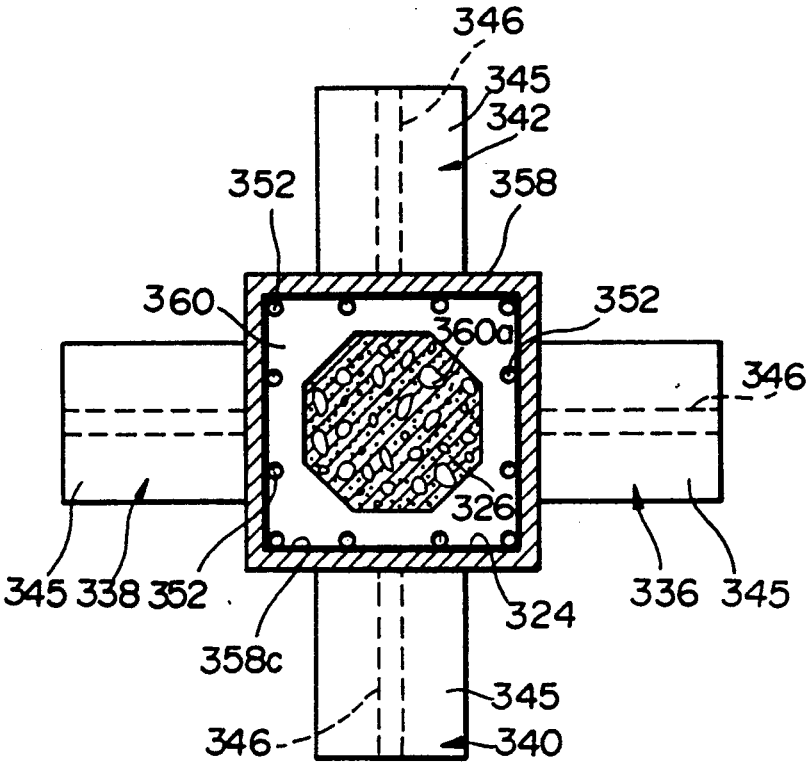
FIG. 20 is a cross-sectional view of a modified form of the steel tube column in FIG. 18.

A modified form of the embodiment in FIG. 18 is illustrated in FIG. 20, in which a tube body not shown and a joint tube 358 have square cross-sections. A inner flange 360 having a plurality of vent holes 352 are circumferentially welded to the inner face 358*c* of the joint tube 358, and a octagonal center hole 360*a* is formed in the center of the inner flange 360.

Figure 21:
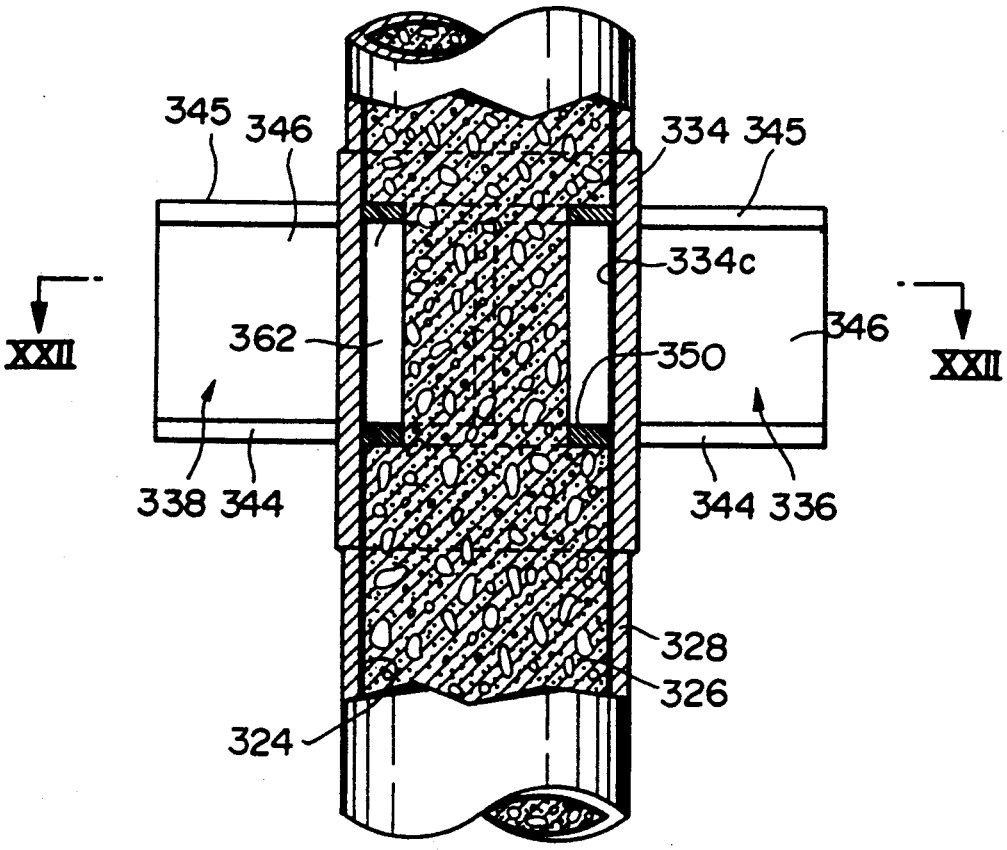
FIG. 21 is a fragmentary front view, partly in section, of another modified form of the steel tube column in FIG. 17.
Figure 22:
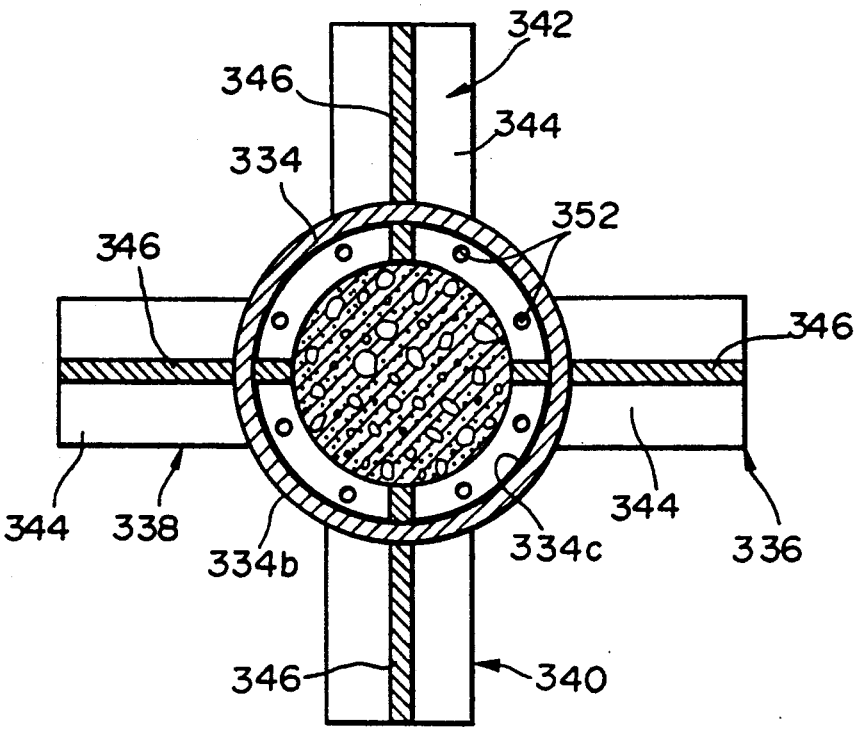
FIG. 22 is a view taken along the line XXII—XXII in FIG. 21.

Another modified form of the column in FIGS. 17 and 18 is shown in FIGS. 21 and 22, in which the joint tube 334 has four ribs 362 welded to the inner face 334*c* thereof so that the ribs 362 are jointed to corresponding web portions 346 of the beam joint members 336, 338, 340 and 342 through a wall 334*d* of the joint tube 334. The ribs 362 project radially inwardly into the core 326 and join the inner flanges 350 and 351. In this modification, shearing force from the web portions 346 of the beam joint members 336, 338, 340 and 342 is transferred via the wall of the joint tube 334 to the ribs 362. Then, the shearing force is transferred directly, or via the flanges 350 and 351, to the core 326 from the ribs 362. Thus, in the presence of the ribs 362, the shearing force from the beams 348 is smoothly transferred to the core 326 and the inner flanges 350 and 351 obtain greater strength against a axial force as compared to the inner flanges in FIGS. 17 and 18.

Figure 23:
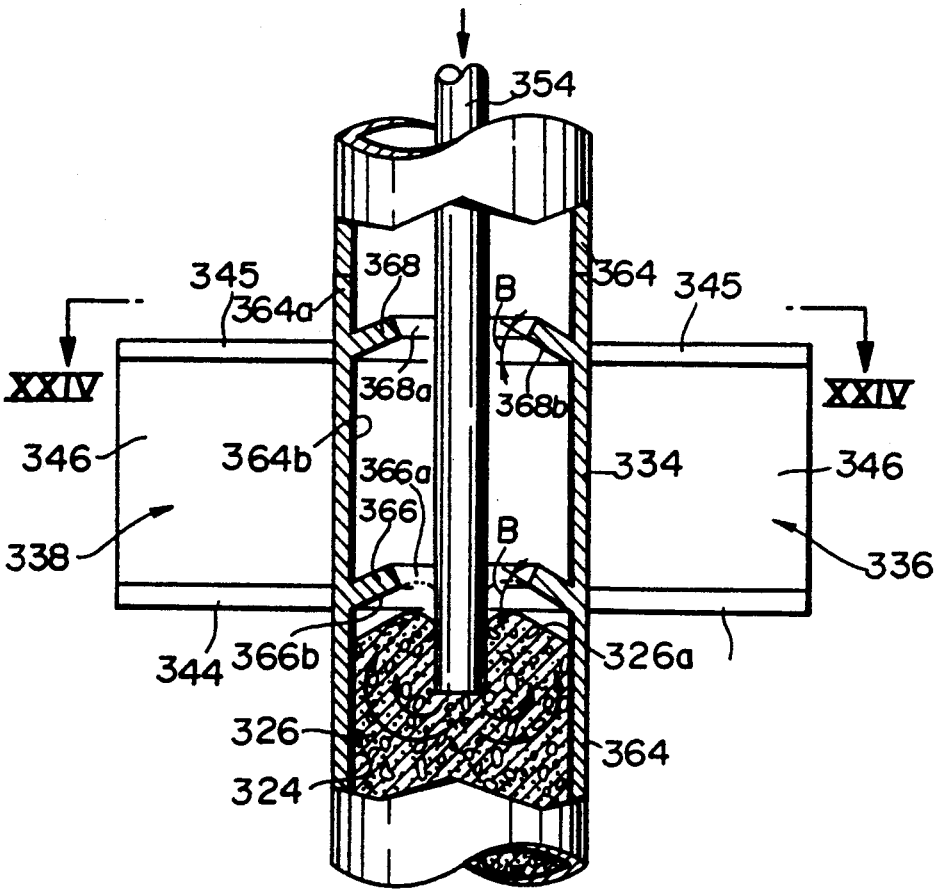
FIG. 23 is a fragmentary front view of still another modified form of the steel tube column in FIG. 17 showing how to fill it with concrete.
Figure 24:
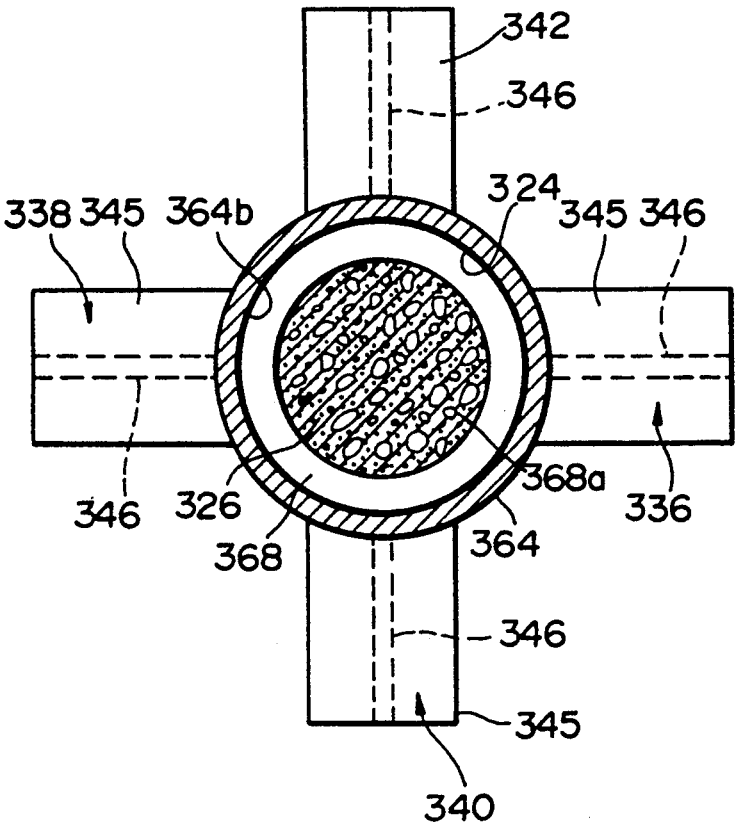
FIG. 24 is a view taken along the line XXIV—XXIV in FIG. 23.

Still another modified form of the column in FIGS. 17 and 18 is shown in FIGS. 23 and 24, in which steel tube 364 is provided at its upper end portion 364*a* with the four beam joint members 336, 338, 340 and 342. A pair of inner flanges 366 and 368 are circumferentially welded to the inner face 364*b* of the steel tube 364 at the same level as corresponding flange portions 344 and 345 of the joint members 336, 338, 340 and 342. The flanges 366 and 368 incline to a plane perpendicular to the axis of the steel tube 364 to converge toward the upper edge 364*a*. Another steel tube is concentrically welded at its lower end to the upper end 364*a* of the steel tube 364. The angle B of inclination of each flange 366 or 368 is generally in the range of 0° to 45°. Preferably, the angle B of inclination, as shown in FIG. 23, is equal to an angle of the slope of the top face 326*a* of the concrete 326 during filling thereof. The angle B of the top face 326*a* may be deduced from a result of a slump test for concrete used.

During the filling process in the above steel tube 364, air between the top face 326 of the concrete 326 and the flange 366 escapes along the lower face 366*b* of the flange 366 toward the center opening 366*a* of the flange 366 as the top face 326*a* of the concrete approaches to the lower face 366*b* of the flange and then goes through the opening 366*a*. In the flange 368, air passes the center opening 368*a* in the same manner. Thus, the concrete 326 fills the whole inner space of the steel tube 364 so that concrete core 326 with no air space is constructed.

The angle of inclination B may be increased as far as it allows corresponding flanges 366 and 368 to transfer the shearing force to the core 326. It is also possible to set the angle B smaller than that of the top face 326*a* of the concrete 326 in view of fluidity of the concrete during placing thereof. In place of the inner flanges 366 and 368, inner flanges having a trapezoidal vertical section with their upper faces not inclining but with their lower faces inclining to the plane perpendicular to the axis of the steel tube 364 may be welded to the inner face 364*b* of the steel tube 364.

Figure 25:
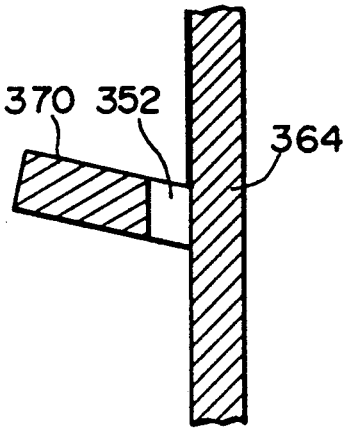
FIG. 25 illustrates fragmentary axial section of a modified form of an inner flange in FIG. 23.

FIG. 25 shows a modified form of the inner flange 366 or 368 in which a inner flange 370 has a plurality of air vent holes 352 circumferentially formed at approximately equal angular intervals. The vent holes 352 extend in an axial direction of the steel tube 364. The vent holes 352 may be formed preferably in the outer peripheral portion of the flange 370 so as to prevent a space not filled with cement from being produced below the flange 370 by allowing air and cement to positively pass through them during the filling of the concrete. Air guiding grooves in communication with the vent holes 352 may be formed in the outer periphery of the lower face 370*a* of the flange 370 so that air is led into the vent holes 352.

Figure 28:
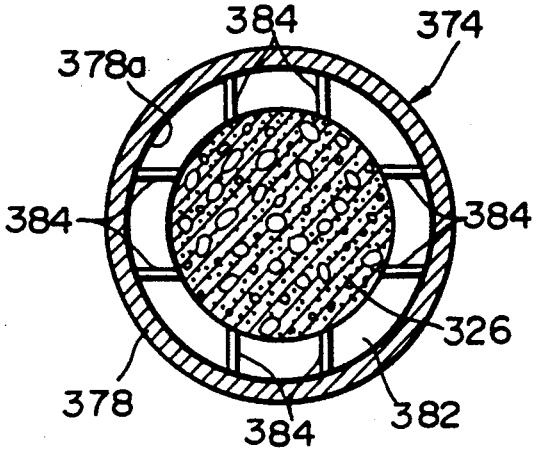
FIG. 28 is a view taken along the line XXVIII—XXVIII in FIG. 27.
Figure 26:
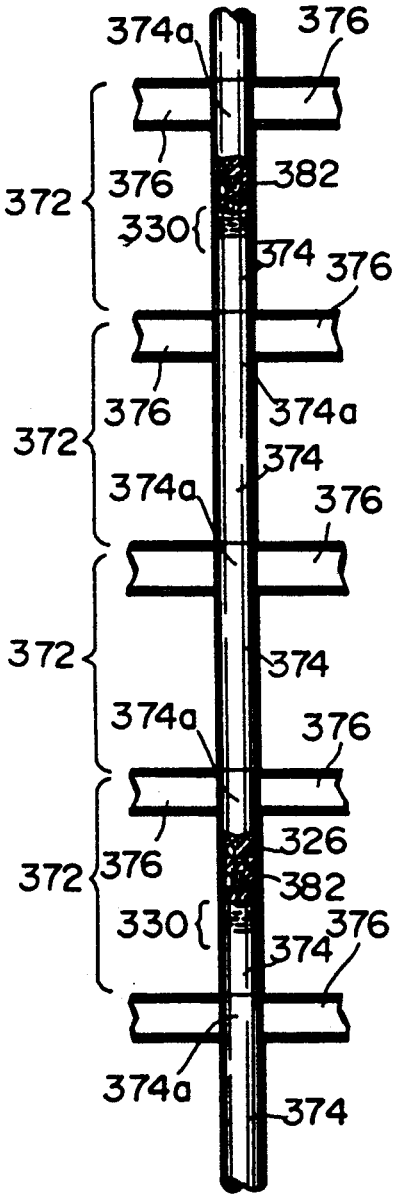
FIG. 26 is a partial view partially cutaway of another building framework having another embodiment of the present invention.
Figure 27:
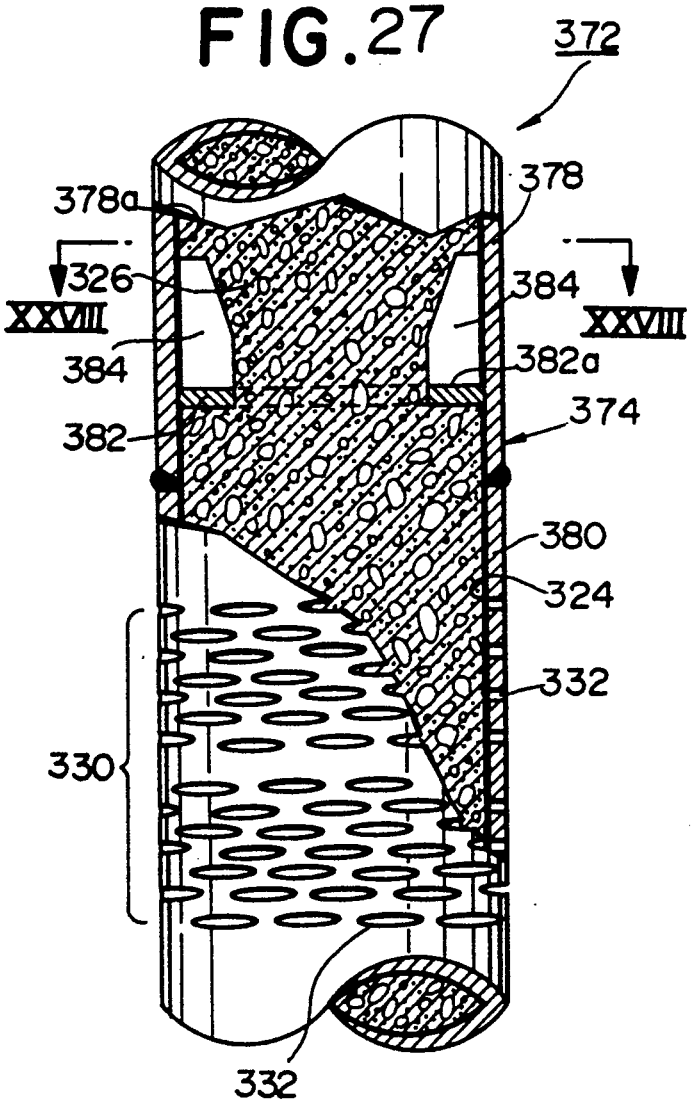
FIG. 27 is an enlarged fragmentary front view, partly in section, of the steel tube column in FIG. 26.

FIGS. 26 to 28 show another embodiment of the invention. In FIG. 26, a plurality of steel tube columns 372 are jointed in series to form a building flamework. Each column 372 has a steel tube 374 provided at its upper end with a joint portion 374*a* to which a plurality of beam joint members 376 are welded. As shown in FIG. 27, the steal tube 374 of every three column 372 consists of a pair of tube pieces 378 and 380 concentrically welded at their ends. The upper tube piece 378 has a inner flange 382 circumferentially welded to the inner face 378*a* thereof at the lower end portion thereof. The flange 382 has a plurality of reinforcing ribs 384 welded at their lower edges to the upper face 382*a* thereof and the ribs 384 are welded at their radially outer edges to the inner face 378*a* of the tube piece 378 (see FIG. 28). That is, the ribs 384 joints the upper face 382*a* of the flange 382 to the inner face 378*a* of the tube piece 378 so that the flange 382 is reinforced against an axial load. On the other hand, the lower tube piece 380 is provided at its upper end with the through slot portion 330. Thus, the steel tube 374 of every three column 372 is provided at its intermediate portion, including its inflection point of moment, with the flange 382 and the through slot portion 330.

Figure 29:
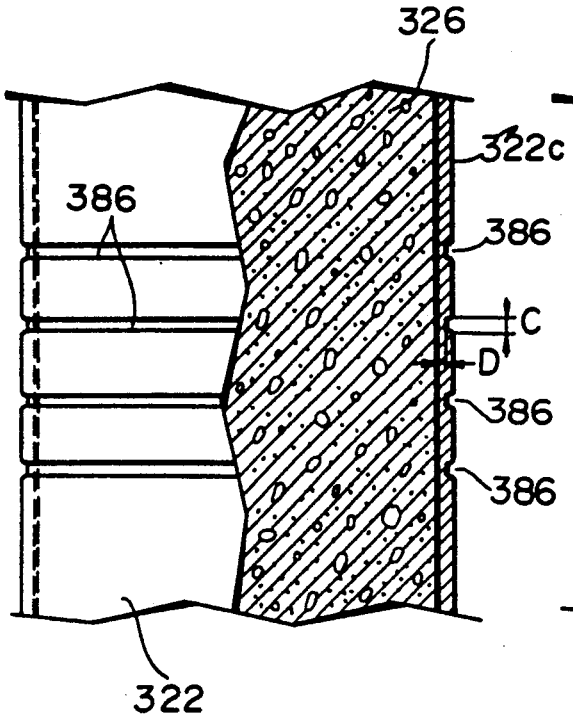
FIG. 29 is a fragmentary front view partially cutaway of a modified form of an axial strain absorbing mechanism in FIG. 17.
Figure 30:
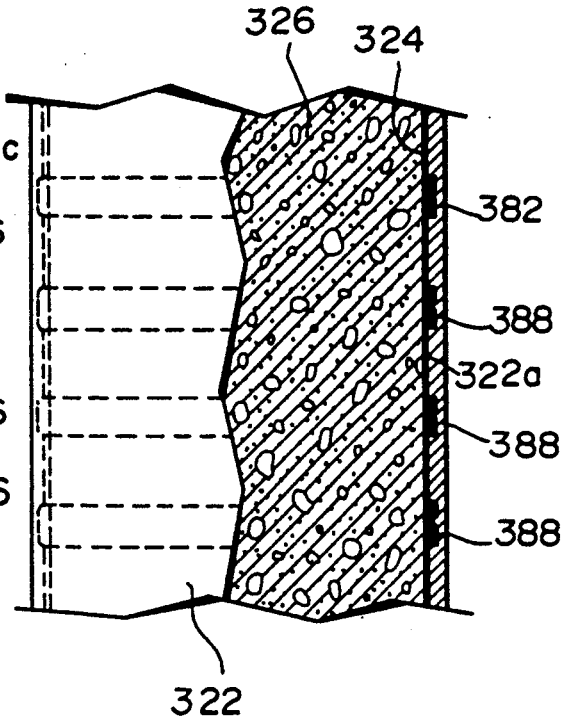
FIG. 30 is a fragmentary front view partially cutaway of another modified form of the axial strain absorbing mechanism in FIG. 1.

A modified form of the the axial strain absorbing mechanism 330 in FIG. 27 is shown in FIG. 29, in which a plurality of circumferential grooves 386 are circumferentially formed in the outer face 322*c* of the steel tube 322 at equal axial spacings. Each groove 386 extends full circumference of steel tube 322. The number of and the width C of the grooves 386 may be selected according to the design condition of the column 320. The thickness D of the bottom wall of each groove 386 is such that the bottom wall has enough strength against the axial compression during the framework construction and against stationay load. Every groove 386 reduces its width C when the axial compression is given to the steel tube 322. Thus, the grooves 386 absorb the axial strain in the steel tube 322 and dissipate the stress. In place of the grooves 386, grooves 388 may be formed in the inner face 322*a* of the steel tube 322 as shown in FIG. 30.

Figure 31:
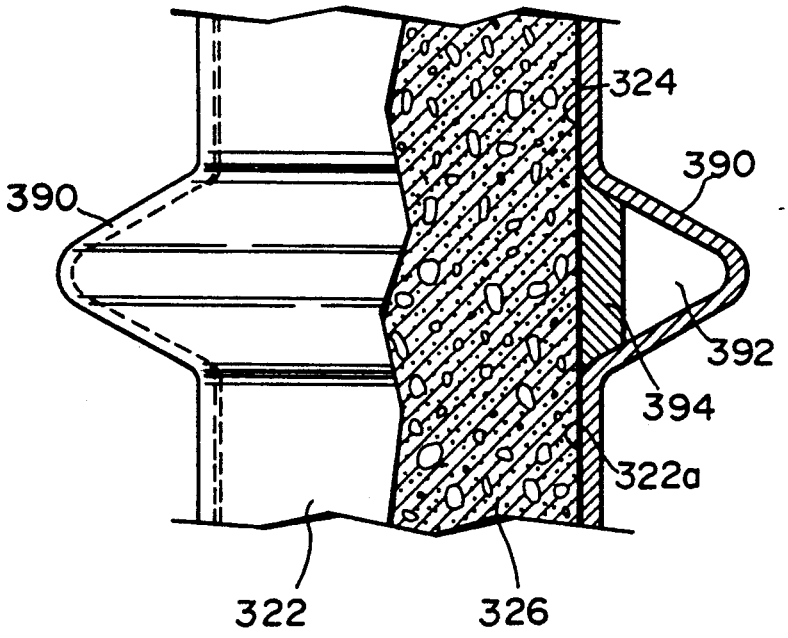
FIG. 31 is a fragmentary front view partially cutaway of still another modified form of the axial strain absorbing mechanism in FIG. 1.

Another modified form of the absorbing mechanism 330 is illustrated in FIG. 31, in which the inner face 322*a* of the steel tube 322 is radially outwardly projected so that a bead portion 390 is formed to protrude from the steel tube 322. A ring-shaped partition member 394 fits into the bead portion 390 for sealing the inside of the bead portion 390 from the interior of the steel tube 322 so as to define a ring-shaped air space 392 between it and the inner faces of the bead portion 390, thus preventing the concrete 326 to enter the air space 392. The partition member 394 may be made of a flexible material such as asphalt, rubber, lead and aluminum. The bead portion 390 is axially deformed when the axial compression exert to the steel tube 322, thus dissipating the axial stress in the steel tube 322.

Figure 32:
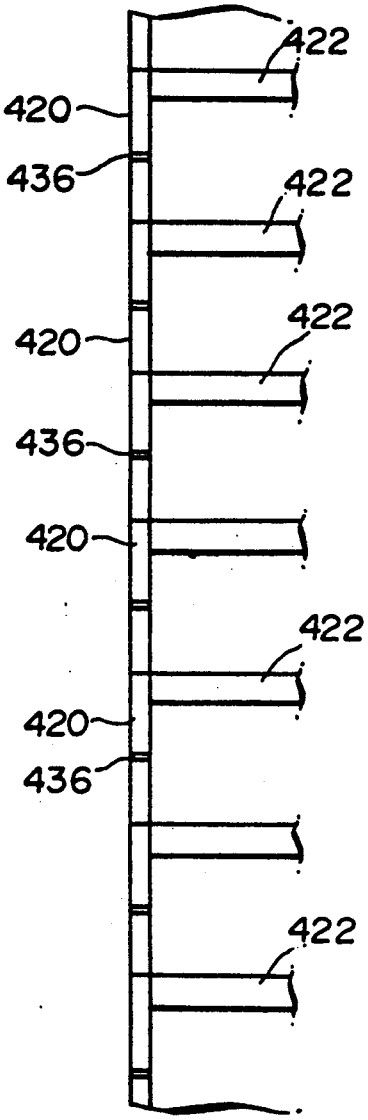
FIG. 32 is a fragmentary view of a building framework having a plurality of filler filled steel tube columns in a modified form of the column in FIG. 1.
Figure 33:
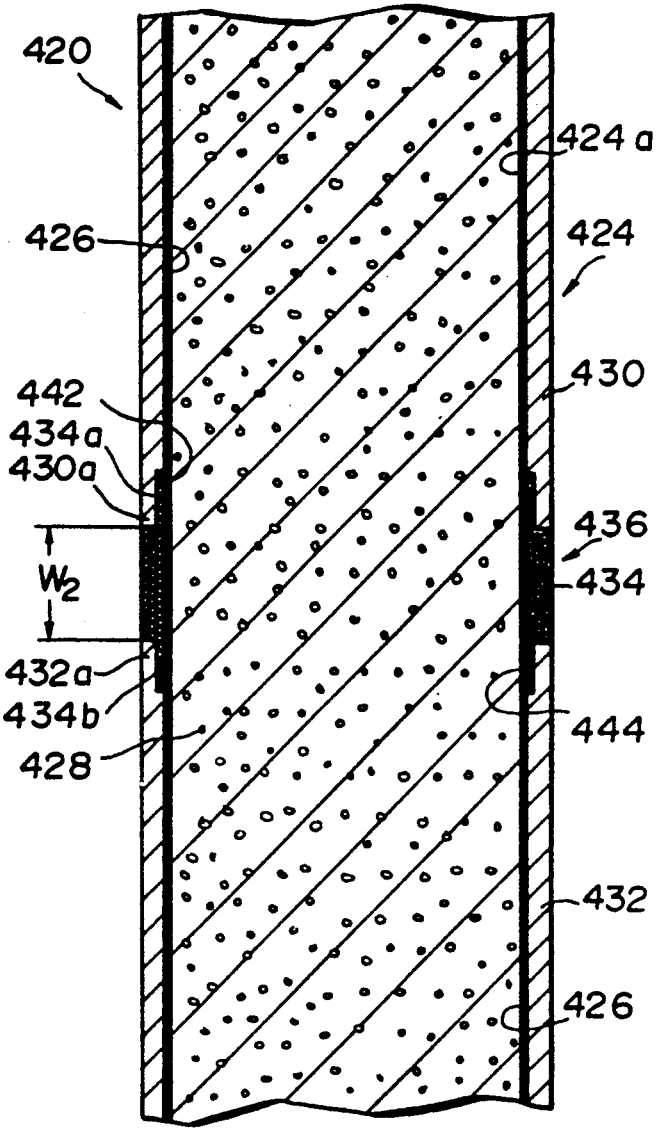
FIG. 33 is an enlarged fragmentary axial-sectional view of the steel tube column in FIG. 32.

FIG. 32 illustrates a part of a building framework using a modified form of the axial strain absorbing mechanism in FIG. 1. This framework has a plurality of steel tube columns 420 concentrically joined in series, and a plurality of steel beams 422, each joined at its inner end to the upper end of each column 420. Each column 420 includes, as shown in FIG. 33, a steel tube 424 coated over its inner face 424*a* with a separating layer 426, and a core 428 disposed within the steel tube 424. The separating layer 426 may be made of a separating material, such as asphalt, grease, paraffin wax, petrolatum, oil, synthetic resin and paper. The core 428 is made of a filler, such as concrete, mortar, sand, soil, clay, glass particles, metal powder, and synthetic resin, which achieves high compressive strength when it is consolidated. The separating layer 426 serves to separate the steel tube 424 from the core 428 so that the core 428 is not bonded to the steel tube 424.

As shown in FIG. 33, the steel tube 424 includes a pair of tube pieces 430 and 432 both made of steel and both having circular cross-sections of the same size. The thickness of each of the tube pieces 430 and 432 is in the range of 1/500 to 1/10 of its outer diameter. These tube pieces 430 and 432 are coaxially aligned and are spaced apart so that a ring-shaped gap 436 is formed between the adjacent ends 430*a* and 432*a* of the tube pieces. In FIG. 32, the gap 436 is placed at an intermediate point, i.e. at the inflection point of moment of each of the columns 420, Therefore, by reducing its axial width W, the gap 436 absorbs the axial strain which develops in the steel tube 424 of each of the columns 420 when the columns 420 undergo an axial compressive load. The axial width W of the gap 436 is preferably in the range of a maximum axial strain of the steel tube 424, which is caused by the overturning moment of the building.

Figure 34:
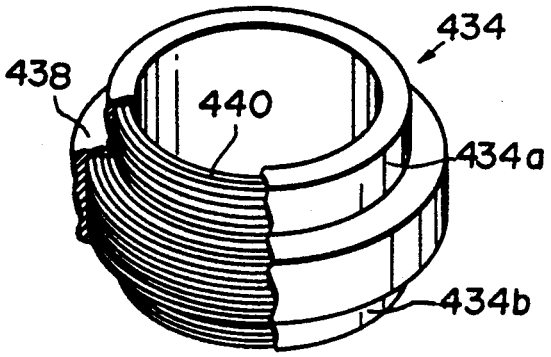
FIG. 34 is a perspective view partially cutaway of the spacing ring in FIG. 33.

The steel tube 424 also includes a spacing ring 434 having an equal inner diameter to the tube pieces 430 and 432. This spacing ring 434 fits coaxially into the gap 436 so that the gap 436 is substantially retained between the tube pieces 430 and 432. In FIG. 34, the spacing ring 434 consists of a ring-shaped matrix 438 and an elongated element 440 which is embedded within the matrix 438 along the circumferential direction of the matrix 438 to form a coil in the matrix. The matrix 438 may be made of rubber, vinyl chloride resin or polyetheretherketone resin so as to achieve a lower compressive strength and a lower rigidity than the tube pieces 430 and 432. The elongated element 440 may be made of aramide fiber, glass fiber or carbon fiber so as to achieve almost as high tensile strength as the tube pieces. Consequently, the spacing ring 434 promotes both high circumferential and radial tensile strength as well as axial flexibility. That is, the ring 434 allows the gap 436 to reduce its axial width W and also provides the core 28 with a lateral confinement when an axial compressive load is applied on the column 420. The thickness of the ring 434 may be determined according to the compressive strength of the tube pieces 430 and 432.

Returning to FIG. 33, the spacing ring 434 has its upper and lower end portions 434*a* and 434*b* which have a smaller outer diameter than the main portion of the ring 434. The tube pieces 430 and 432 are provided at their adjacent ends 430*a* and 432*a* respectively with recesses 442 and 444 which extend circumferentially in the inner faces of the tube pieces 430 and 432. The spacing ring 434 is engaged with both the tube pieces 430 and 432 by inserting its upper and lower end portions 434*a* and 434*b* respectively into the recesses 442 and 444 of the tube pieces.

In the presence of the separating layer 426, the steel tube 424 is axially movable relative to the core 428. Therefore, when the core 428 undergoes axial compression, the steel tube 424 follows the core 428 with a much smaller degree of axial strain than the prior art steel tube bonded to its core. Moreover, the gap 436 absorbs the axial strain in the steel tube 424 by reducing its axial width W. In other words, the steel tube 424 reduces its axial length by deforming only the spacing ring 434, when the axial compression is exerted on it. Therefore, the axial strain is hardly brought into the tube pieces 430 and 432 even though it develops in the core 428. This means that the steel tube 424 increases its strength against the circumferential stress which develops in it due to transverse strain of the core 428, thus, in the view of Mieses's yield conditions, enhancing lateral confinement of the steel tube 424 which is provided on the core 428. As a result, the compression strength of the core 428 is efficiently enhanced thereby enabling a considerable reduction in the cross-section of the column 420 as compared to the prior art column.

Figure 35:
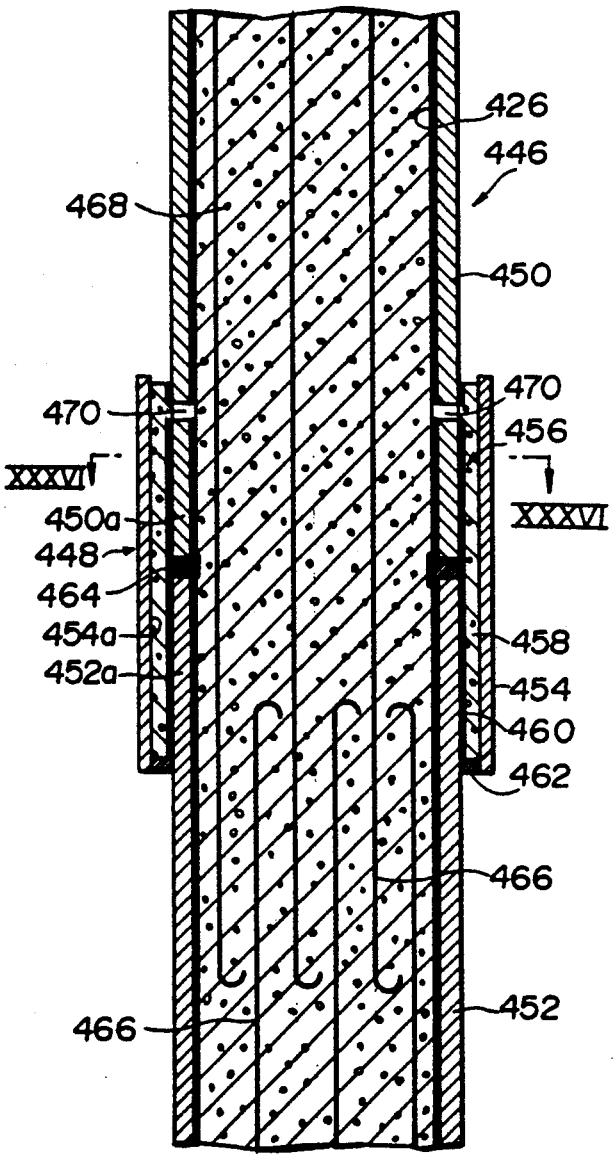
FIG. 35 is a fragmentary axial-sectional view of another embodiment of the present invention.
Figure 36:
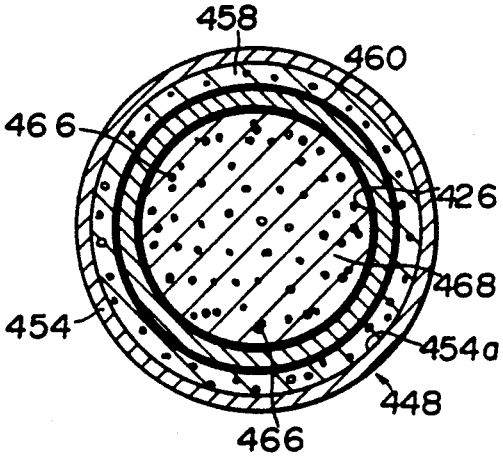
FIG. 36 is a view taken along the line XXXVI—XXXVI in FIG. 35.

FIG. 35 illustrates another embodiment of the present invention, in which a steel tube 446 has a pipe coupling 448 which couples tube pieces 450 and 452 in series. The pipe coupling 448 includes a pipe body 454 which surrounds both the adjacent ends 450*a* and 452*a* of the tube pieces 450 and 452 to define an annular space 456 between its inner face 454*a* and the tube pieces (see FIG. 36). An inner layer 458, made of concrete in this embodiment, is disposed within the annular space 456 to fill out the space, and a separting layer 460 is interposed between the inner layer 460 and the tube pieces 450 and 452 so that the inner layer is not bonded to the tube pieces 450 and 452. The separating layer 460 may be made of the same separating material as that used in FIG. 33. An annular packing 462 fits in the lower end of the pipe body 454 and around the tube piece 452 to close the lower opening of the space 456. In the presence of the pipe coupling 448, the steel tube 446 increases its mechanical strength and still reduces its axial length by reducing the width of the gap 436 when the axial compression is exerted on it. In this embodiment, a spacing ring 464 which is made of only flexible material such as rubber fits concentrically into the gap 436, and a plurality of reinforcements 466 are axially embedded within a core 468. The core 468 may be made of hydraulic material such as concrete. The upper tube piece 450 is provided at its adjacent end portion with a plurality of through holes 470. When concrete is being filled into the tube piece 450, the concrete passes through the holes 470 out of the tube piece 450 thereby filling the annular space 456 at the same time that it forms the core 468.

Figure 37:
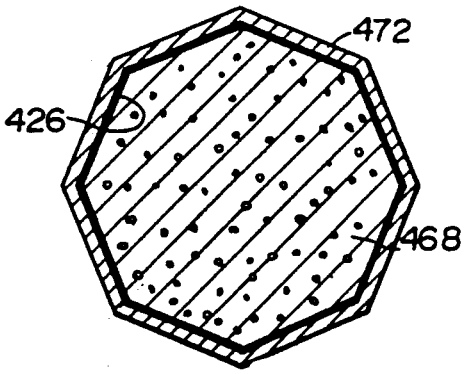
FIG. 37 is a cross-sectional view of a modification of the steel tube column in FIG. 36.

The separating layer 460 may be interposed between the inner layer 458 and one of the tube pieces 450 and 452 instead of being interposed between the inner layer and both the tube pieces. A pipe body directly fitting around both adjacent ends 450*a* and 452*a* of tube pieces 450 and 452 may be employed in place of the pipe body 454. Prestressed reinforcements may be employed in place of the reinforcements 466. Further more, in place of the spacing rings in FIG. 33 and 35, a plurality of block-shaped spacers made of flexible material may be interposed between the tube pieces at equal angular intervals around the axis of the tube pieces. Tube pieces having a polygonal cross-section, such as a tube piece 472 having an octagonal cross-section as shown in FIG. 37, may be employed in place of the tube pieces in FIG. 33 and 35.

Figure 38:
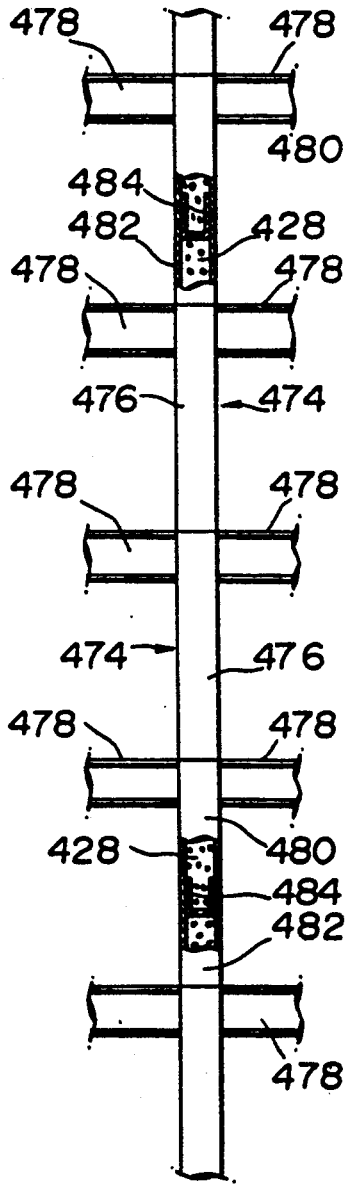
FIG. 38 is a fragmentary view partly in section of another building framework having still another embodiment according to the present invention.
Figure 39:
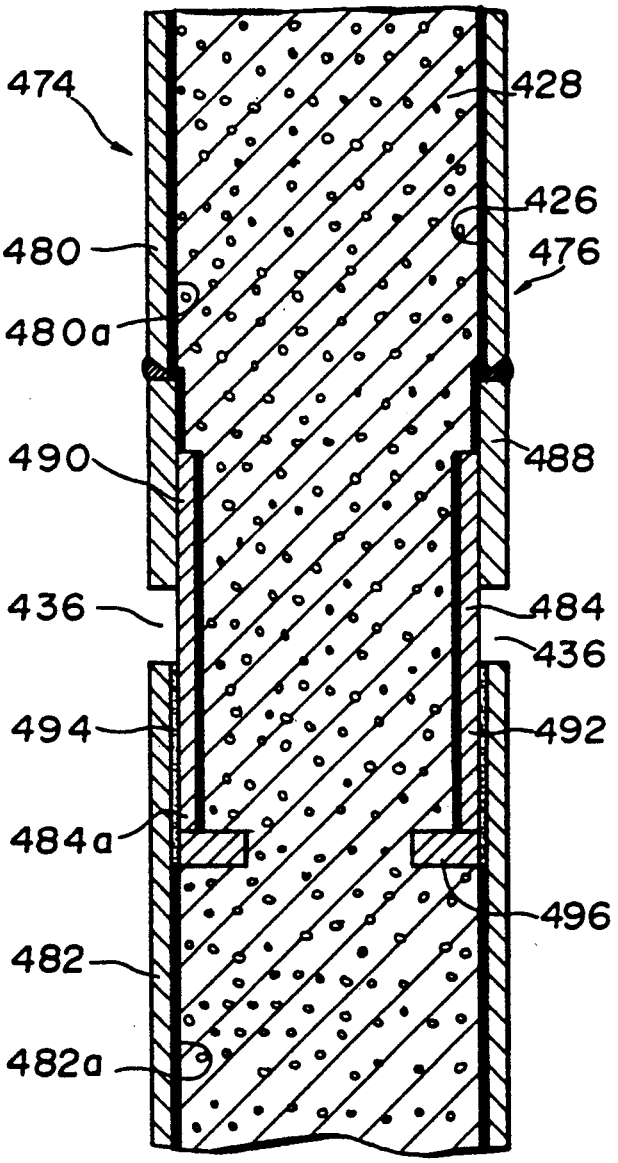
FIG. 39 is a enlarged fragmentary axial-sectional view of the steel tube column in FIG. 38.

FIGS. 38 and 39 show still another embodiment of the invention. In FIG. 38, a plurality of columns 474 are joined in series to form a building framework. Each column 474 has a steel tube 476 to the upper end portion of which a plurality of steel beams 478 are welded. The steel beams 478 of each column 474 are to support each floor slab of the building subsequently. As illustrated in FIG. 39, the steel tube 476 of every three columns 474 includes, a pair of tube pieces 480 and 482, and a joining tube 484 which couples the tube pieces 480 and 482 concentrically in series. The upper tube piece 480 consists of, a tube piece body 486, and a ring-shaped tube 488 coaxially welded at its upper end to the lower end of the tube piece body 486. That is, ring-shaped tube 488 forms the adjacent end portion of the upper tube piece 480. The joining tube 484 is joined coaxially at its upper end portion 490 to the inner face 480*a* of the upper tube piece 480, and fits its lower end portion 492 coaxially to the inner face 482*a* of the lower tube piece 482. Between the lower end portion 492 of the joining tube 484 and the inner face 482*a* of the lower tube piece 482, a lubricating layer 494 made of antifriction material such as tetrafluoroethylene is interposed so that the joining tube 484 is axially slidable in relation to the lower tube piece 482. Furthermore, joining tube 484 is welded circumferentially at its lower end 484*a* with an inner flange 496 which project radially inwards so that an axial load applied to the upper tube piece 480 is transferred via the flange 496 to the core 428.

In assembling the steel tube column in FIG. 39, the joining tube 484 is coaxially welded to the inner face of the ring-shaped tube 488 before or after the inner flange 496 is welded to it in a assembling factory. The ring-shaped tube 488 is then welded at its upper end to the lower end of the tube piece body 486. Thereafter, the upper tube piece 480 with the joining tube 484 thus prepared is brought into a construction site and is coupled with the lower tube piece 482 which has already been erected there so that the gap 436 is defined between the tube pieces 480 and 482. Then, a concrete is charged into the steel tube 476 (i.e. the tube pieces 480 and 482 and the joining tube 484) and cured. Alternatively, the ring-shaped tube 88 with joining tube 484 is coupled to the lower tube piece 482 at the construction site, and then the tube piece body 486 is welded at its lower end to the ring-shaped tube 488 as a process preceding the concrete filling process. In either of these assembling methods, spacing instruments for retaining the gap 436 between the tube pieces 480 and 482 are required. For example, these instruments may be spacers which are attached with the capacity of being detached between the adjacent ends 480*a* and 482*a* of the tube pieces or the spacing rings like those shown in FIGS. 33 and 35. Otherwise, the tube pieces 480 and 482 are coupled together with their adjacent ends in contact with each other, and after the concrete is charged and cured either of the adjacent end portions are cut off so that the gap 436 is formed between them. Careful operation is required upon cutting off the end portion so as not to damage the joining tube 484.

In the construction in FIG. 38, shearing force from the beams 478 is transferred to each steel tube 476 to which the beams 478 are joined. Then, the shearing force in the three continuous steel tubes 476 between two joining tubes 484 is transferred via the inner flange 496 of the lower joining tube 484 to the core 428 without being transferred to steel tubes 476 aligned lower than the gap 436. In other words, the steel tube 476 is subjected to the shearing force (an axial compressive force) transferred from the beams 478 of only three columns. That is, the steel tube 476 undergoes much less axial compressive force than the prior art steel tube, which enhances lateral confinement of the steel tube 476 provided on the core 428.

Figure 40:
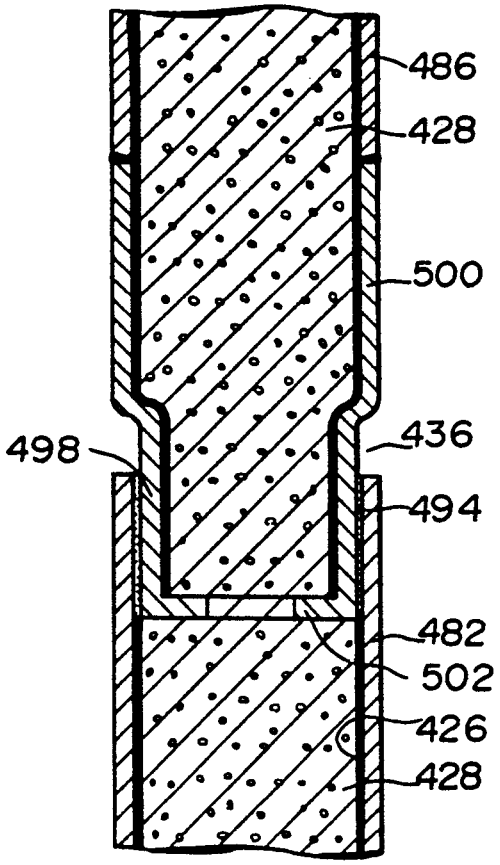
FIG. 40 is a fragmentary axial-sectional view of a modified form of the steel tube column in FIG. 39.

A modified form of the steel tube column in FIG. 39 is illustrated in FIG. 40, in which a joining tube 498 and a ring-shaped tube 500 are molded into a unitary construction. An inner flange 502 and the joining tube 498 are also molded together, otherwise the inner flange 502 is welded to the joining tube 498. The column with this construction is easy to assemble since the process of joining the joining tube to the ring-shaped tube is omitted. A ring-shaped tube integral with the tube piece body 486 may be employed in place of the tube 500.

Figure 41:
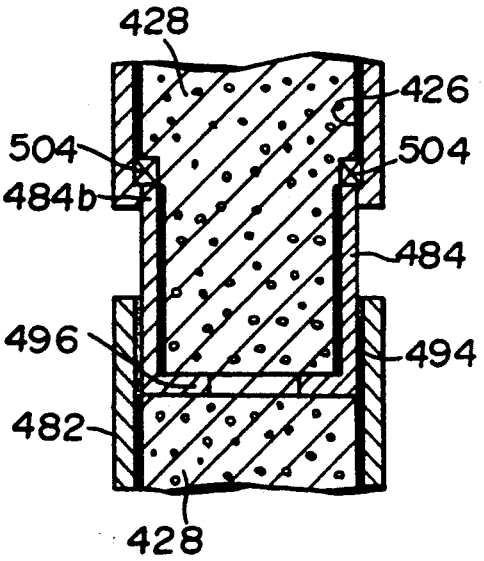
FIG. 41 is a fragmentary axial-sectional view of another modified form of the steel tube column in FIG. 39.
Figure 42:
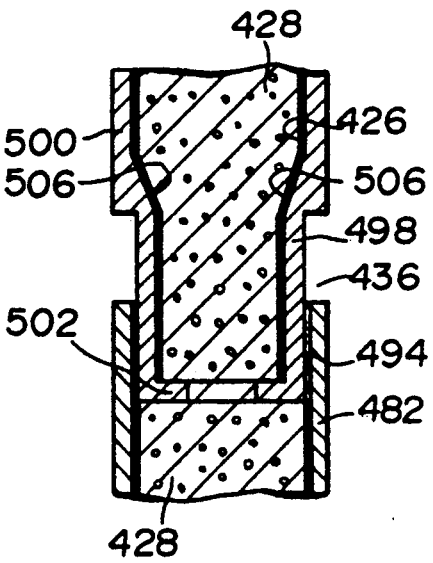
FIG. 42 is a fragmentary axial-sectional view of still another modified form of the steel tube column in FIG. 39.

Another modified form of the column in FIG. 39 is shown in FIG. 41, in which the joining tube 484 is circumferentially provided at its upper end **484*b* with a pliant member 504. This member 504 is made of, for example, rubber so as to reduce an axial compressive load exerted from the core 428 to the joining tube 484. As shown in FIG. 42, a ramp 506 may be formed at the upper end 484*b* of the joining tube 484 in place of the pliant member 504,. This ramp 506 is inclined to a plane perpendicular to the axis of the joining tube 484** to converge toward the lower end of the joining tube.

Figure 43:
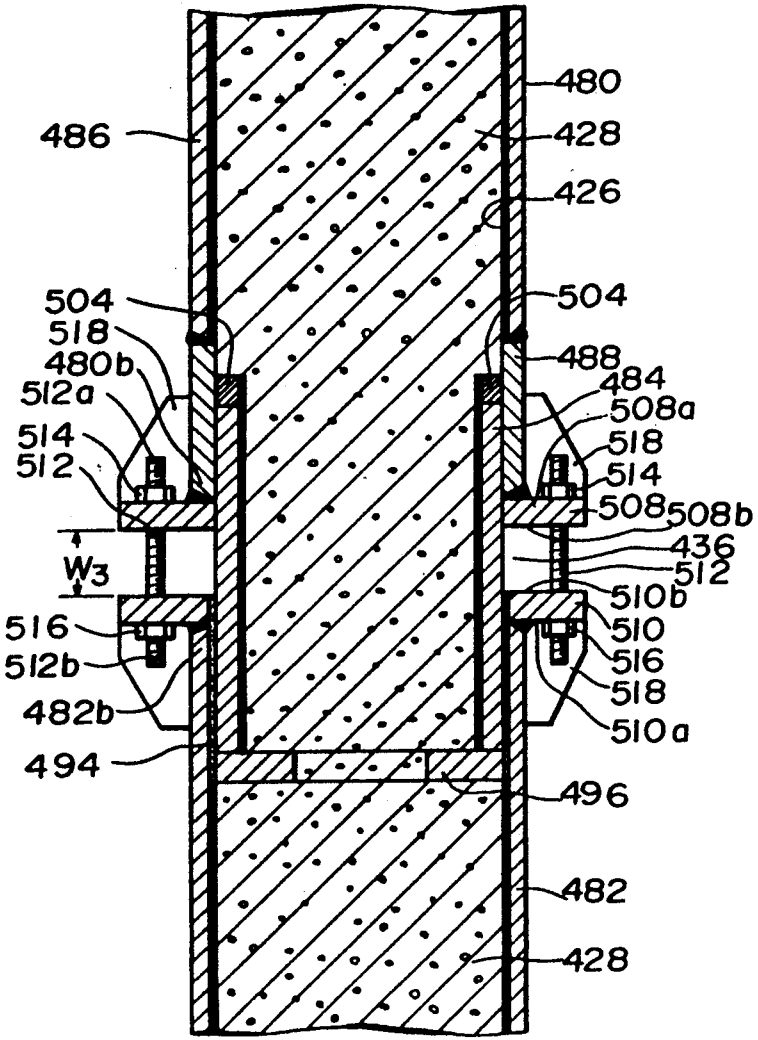
FIG. 43 is a fragmentary axial-sectional view of a further embodiment according to the present invention.

FIG. 43 illustrates another embodiment of the invention, in which the tube pieces 480 and 482 are circumferentially welded at their adjacent ends **480*b* and 482*b* with a pair of outer flanges 508 and 510 respectively. These outer flanges 508 and 510 project radially outwards facing each other and have a plurality of screw rods 512 which pass loosely through both of them at equal angular intervals around their axis. The opposite end portions 512*a* and 512*b* of each of the rods 512 are threadedly engaged with a pair of nuts 514 and 516 respectively and thereby brought into firm contact with the outer surfaces 508*a* and 510*a* of the outer flanges respectively through the nuts 514 and 516. This construction prevents the tube pieces 480 and 482 from going away from each other while allowing them to approach each other. Accordingly, the column in this embodiment is capable of resisting an axial tensile load due to the overturning moment of the building caused by short time loading such as seismic force and thus enhancing the building in rigidity and durability. In addition, each of the outer flanges 508 and 510 has a plurality of reinforcing ribs 518 mounted on it at equal angular intervals around its axis. The ribs on the upper flange 508 are welded at their lower edges to the outer surface 508*a* of the flange 508 and welded at their radially inner edges to the outer face of the upper tube piece 480. On the other hand, the ribs 518 on the lower flange 510 are welded at their upper edges to the outer surface 510*a* of the flange 510 and at their radially inner edges to the outer face of the lower tube piece 482. That is, the ribs 518 joins the outer surfaces 508*a* and 510*a* of the outer flanges to the outer faces of the tube pieces 480 and 482 respectively so that the flanges 508 and 510** are reinforced against an axial load.

In assembling the steel tube column in FIG. 43, the joining tube 484, ring-shaped tube 488, the inner flange 496, the outer flange 508, ribs 518, and the pliant member 504 are joined together in a steel assembling factory, and then the tube piece body 486 is welded to the ring-shaped tube 488. This upper tube piece 480 with the other joined members is then brought into a construction site and coupled with the lower tube piece 482 welded with the outer flange 510, which has already been erected there. Upon this coupling process, spacers (not shown) may be interposed between the flanges 508 and 510 so that the ring-shaped gap 436 is retained between the flanges. Thereafter, the nuts 514 and 516 engaging with the screw rods 512 are attached to the outer flanges 508 and 510. Finally, a concrete is charged into the tube pieces 480 and 482 and the joining tube 484, and after the concrete is cured, the spacers are removed from the gap 436. As the columns are joined longer, the steel tubes undergo more compressive load thereby reducing the axial width W3 of the gap 436. In this case, the threaded connection between each of the screw rods 512 and the nuts 514 and 516 must be retightened so that the nuts are brought again into direct contact with the outer surfaces **508*a* and 510*a* of the flanges 508 and 510**.

The tube piece body 486 may be welded to the ring-shaped tube 488 after the ring-shaped tube 488 with the other joined members is coupled with the lower tube piece 482 and the screw rods 512 are attached to the flanges 508 and 510. In another way, the concrete may be charged into the lower tube piece 482 before the upper tube piece 480 or the ring-shaped tube 488 is coupled with the lower tube piece 482. In case the spacer is made of flexible material, it may be kept in the gap 436 even after the concrete is cured. In place of the spacers, another pair of nuts may be threadedly engaged with each of the screw rods 512 so as to be in direct contact with the inner facing surfaces **508*b* and 510*b* of the flanges 508 and 510** respectively.

Figure 44:
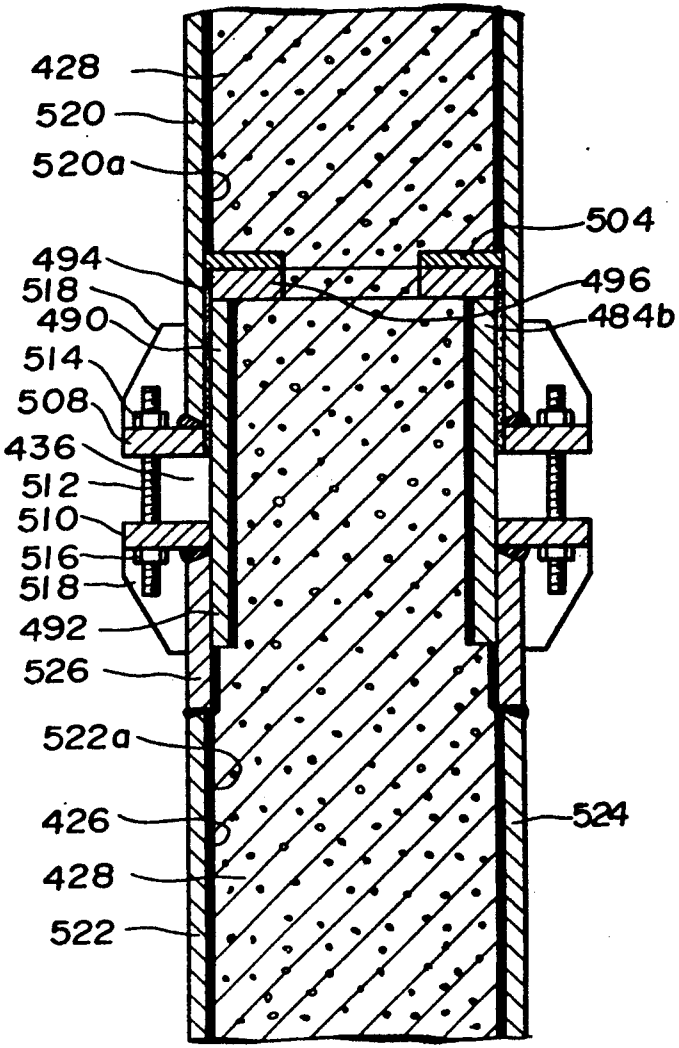
FIG. 44 is a fragmentary axial-sectional view of a modified form of the steel tube column in FIG. 43.

FIG. 44 shows a modified form of the column in FIG. 43, in which the lower tube piece 522 consists of, a tube piece body 524, and a ring-shaped tube 526 coaxially welded at its lower end to the upper end of the tube piece body 524. That is, ring-shaped tube 526 forms the adjacent end portion of the lower tube piece 522. The joining tube 484 is joined coaxially at its lower end portion 492 to the inner face **522*a* of the lower tube piece 522, and fits coaxially its upper end portion 490 to the inner face 520*a* of the upper tube piece 520. Between the upper end portion 490 of the joining tube 484 and the inner face 520*a* of the upper tube piece 520, a lubricating layer 494 is interposed so that the joining tube 484 is axially slidable in relation to the upper tube piece 520. Furthermore, joining tube 484 is welded at its upper end 484*b* circumferentially with an inner flange 496 so that an axial load applied to the lower tube piece 522 is transferred via the flange 496 to the core 428. The pliant member 504 is circumferentially attached on top of the inner flange 496**.

In the construction in FIG. 44, shearing force from the beams which is joined to the lower tube piece 522 is transferred to the lower tube piece 522. Then, the shearing force in the lower tube piece 522 is transferred via the inner flange 496 to the core 428. Shearing force in the upper tube piece 520 is not transferred to the lower tube piece 522 because of the gap 436. That is, according to the same reason as the embodiment in FIG. 39, lateral confinement of the tube pieces 520 and 522 which is provided on the core 428 is enhanced.

In place of the inner flange 496, a cross-shaped member may be welded at its ends to one of the opposite ends 484*a* and 484*b* of the joining tube 484. This cross-shaped member is formed, for example, by a pair of steel bars perpendicularly welded to each other to form a cross shape. The inner flange 496 as well as the cross-shaped member may be welded to the inner face of the joining tube 484 instead of being welded to one of the opposite ends of the joining tube 484. Also, the outer flanges 508 and 510 may be welded to the outer faces of the tube pieces instead of being welded to the adjacent ends of the tube pieces. A pliant member made of foam polystyrene or clay may be employed in place of the pliant member 504.

Figure 45:
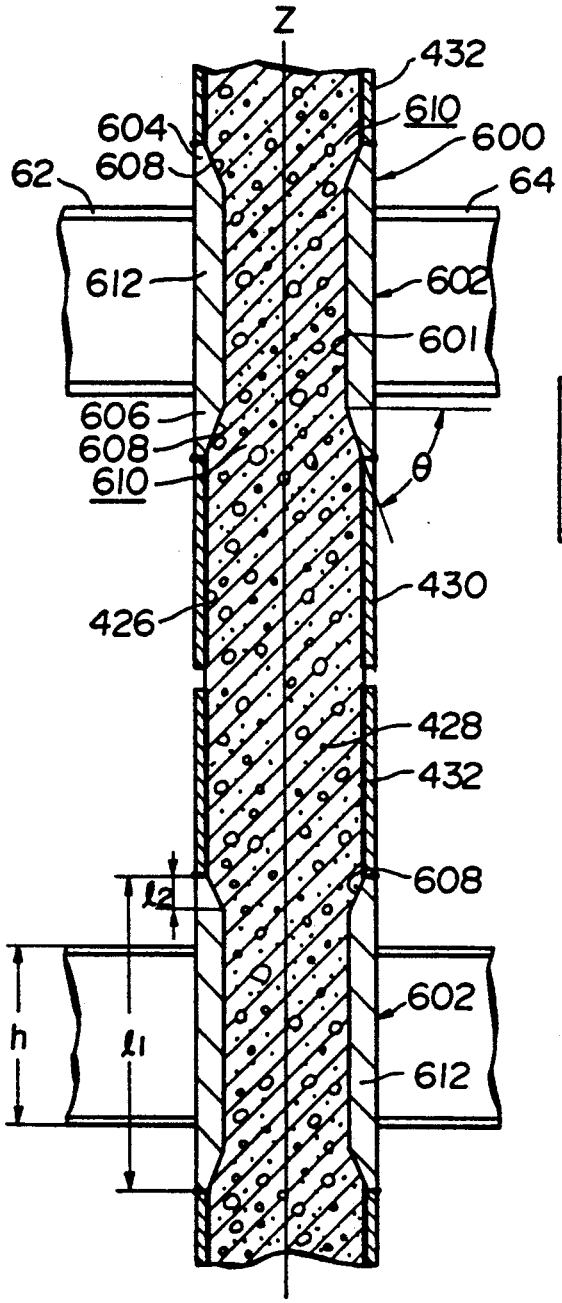
FIG. 45 is an axial section in a modified scale of a modified form of the steel tube column in FIG. 33.

A modified form of the column in FIG. 33 is illustrated in FIG. 45, in which the column 600 includes steel joint tubes 602 for joining beams to it. Each joint tube 602 is made by centrifugal casting and hence has a roughened inner face 601. The joint tube 602 has an upper circumferential wedge portion 604 at its upper end portion and a lower circumferential wedge portion 606 at its lower end portion. Each of the upper and lower wedge portions 604 and 606 has a circumferential wedge face 608 tapering inwardly toward the axis Z of the joint tube to define a tapering opening 610. The joint tube 602 is larger in thickness at its central portion 612 than and equal in thickness at its upper and lower ends to tube pieces 430 and 432. The inclined angle $\Theta$ of each wedge face 608 to the horizontal plane is preferably about 45° or more. Further, the length $l_1$ of each joint tube 602 is preferably longer than $h+2l_2$ where h is the height of each beam or beam joint member 62, 64, . . . and $l_2$ is the vertical length of each wedge face 608. With such a construction, a vertical load applied from beams to corresponding joint tubes 602 is transmitted by the wedge effect of wedge faces 608 to concrete core 428. If air vent holes 352 of circumferential flanges 350 and 351 in FIG. 17 are not provided, there are possibilies such that an air space is produced within concrete core 326 below each flange 350, 351 since the placed concrete descends during its hardening, and such that aggregates in the concrete are prevented by circumferential flanges 350 and 351 from descending together with mortar, thus providing nonuniform strength to the concrete core 326. For reducing such possibilies, concrete placement into the tube 328 is discontinued when concrete level reaches to flanges and then resumed after sufficient hardening thereof. Such a manner of concrete placement is time consuming. The column of this modification enables concrete placement into it by a single operation.

Figure 46:
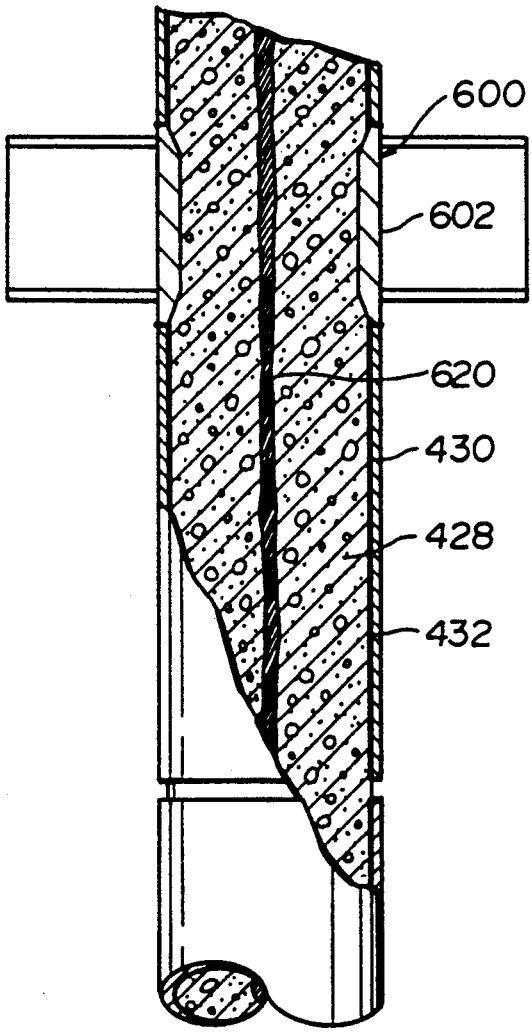
FIG. 46 is an axial section in a modified scale of a still modified form of the steel tube column in FIG. 45.

For resisting a force, tending to pull tube pieces 430, 432 out of the concrete core 428, with the wedge effect, a steel material 620, such as a deformed bar, may be disposed concentrically within the core 428 as in FIG. 46.

FIGS. 47 to 50 illustrate various modified forms of the joint tube 602 in FIG. 45.

Figure 47:
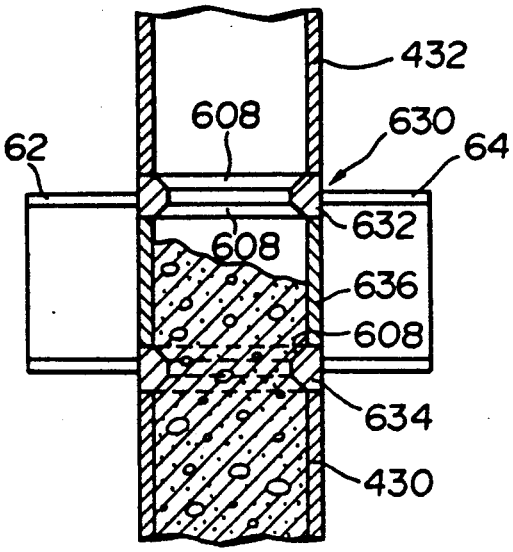
FIGS. 47 to 50 are axial sections of still modified forms of the steel tube column in FIG. 1.

In FIG. 47, a joint tube 630 includes a pair of an upper joint steel ring 632 and a lower joint steel ring 634 and a short steel tube 636 having the upper and lower rings 632 and 634 welded concentrically to its upper and lower ends, respectively. Each of upper and lower rings 632 and 634 has circumferential wedge faces 608 and 608 at respective inner edges of its upper and lower ends.

Figure 48:
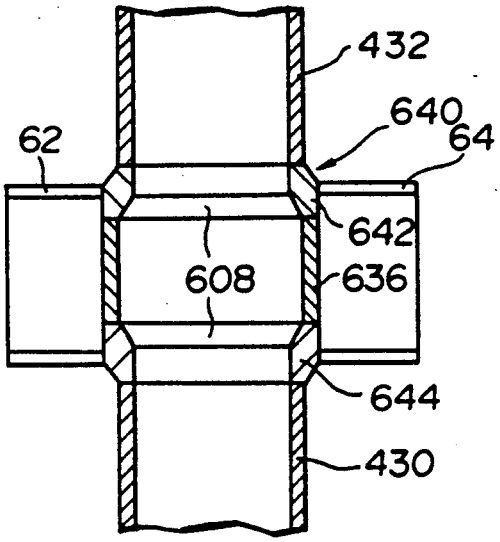

A joint tube 640 in FIG. 48 includes a pair of upper and lower joint steel rings 642 and 644 and a short steel tube 636 having the upper and lower rings 642 and 644 welded concentrically to its upper and lower ends, respectively. Each of the upper and lower rings 642 and 644 are welded to respective tube pieces 432 and 430 so that inner faces of the former are flush with respective inner faces of the latter. The upper ring 642 has a circumferential wedge face 608 at the inner edge of its lower end and the lower ring 644 has a circumferential wedge face 608 at the inner edge of its upper end.

Figure 49:
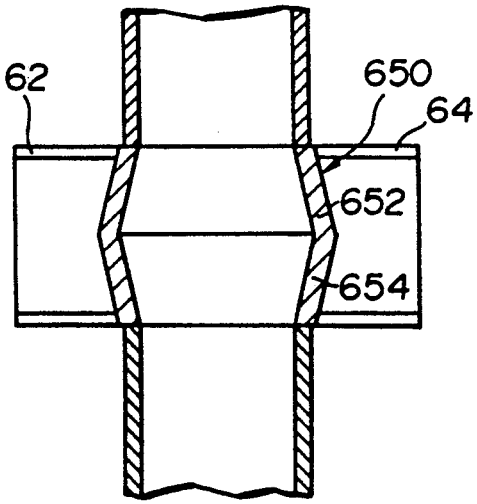

A joint tube 650 in FIG. 49 has an upwardly tapering upper half 652 and a downwardly tapering lower half 654 concentrically and integrally formed with the upper half.

Figure 50:
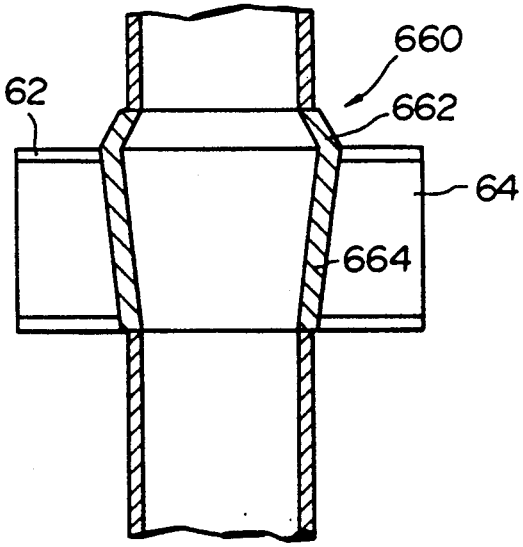

FIG. 50 illustrates a modified form of the joint tube 650 in FIG. 49. The joint tube 660 includes an upwardly tapering portion 662 and a downwardly tapering lower portion 664 concentrically and integrally formed with the upper portion 662, the upper portion 662 having a larger height than the lower portion 664.

EXAMPLE 1

A steel tube having a 114 mm outer diameter, a 6.0 mm thickness and a 340 mm length was prepared. Young's modulus $E_s$ of the steel tube was $2.1\times10^6$ Kg/cm$^2$ and yield point thereof was 2900 Kg/cm$^2$. An asphalt was spayed over the inner face of the steel tube to form a 100 $\mu$ asphalt coating. A concrete which was prepared in composition as given in Table 1 was charged into the asphalt coated steel tube from the bottom to the top to form a test column. In Table 1, each component is given in Kg per 1 m$^3$ of the concrete prepared. A concrete test piece made of the concrete above and having a 100 mm diameter and a 200 mm height had cylinder strength of 602 Kg/cm$^2$, which is substantially equal to strength according to ACI (U.S.A.), and Young's modulus of $3.74\times10^5$ Kg/cm$^2$. The test column was cured for 4 weeks and then axial load-strain behavior of the test column was determined. In this test, the test column was vertically supported in a hydraulic test machine and static axial loads were applied by a hydraulic jack to only the top face of its concrete core. The results are given in FIG. 51 in which axial strain $\epsilon_{SZ}$ and hoop strain $\epsilon_{S\theta}$ of the steel tube are given in the solid lines and axial strain $\delta_C$ of the concrete core is given by the dot and chain line. It was noted that the ultimate axial load was 168 metric tons and the yield strength of the concrete core was 2056 Kg/cm$^2$.

COMPARATIVE TEST 1

A concrete having the same composition as in Example 1 was charged into another steel tube having the same dimensions and properties as the steel tube in Example 1. The same test was conducted on this test piece except that static axial loads were applied to the overall top end face thereof. The results are plotted in FIG. 52, from which it is clear that the ultimate axial load was 132 metric tons and the yield strength of the concrete core was 1616 Kg/cm$^2$.

TABLE 1

| | Example 1 | Comparative Test | (Kg/m$^3$) Example 2 |
|---|---|---|---|
| Water | 145 | 180 | |
| Cement | | 580 | 423 |
| Sand | 670 | 668 | |
| Aggregate | | 893*1 | 1034*2 |

TABLE 1-continued

| | Example 1 | Comparative Test | (Kg/m³) Example 2 |
|---|---|---|---|
| Slump (cm) | | 20.0 | 16 |

*[1]5-15 mm sand stone river gravel
*[2]10-20 mm sand stone river gravel

EXAMPLE 2

A slit steel tube 2800 mm long which consisted of a slit steel tube piece and a pair of two steel tube members coaxially welded at their one ends to the opposite ends of the slit steel tube piece as shown in FIG. 7. The slit steel tube had a 100 μ asphalt coating as in the Example 1. The dimensions of the slit steel tube piece and the two steel tube members are given in Table 2. Young's modulus $E_s$ of the steel tube was $2.1\times10^6$ Kg/cm² and yield point thereof was 3100 Kg/cm². The slit steel tube piece had nine rows of slits formed by a high speed cutting, each row including 4 slits having an equal angular spacing $\theta_2=15°$. Each slit had a 3 mm vertical width and extending in an angular range $\theta_1$ of 75°. The distance $D_1$ between centers of slits of adjacent rows was 10 mm and the distance $D_2$ between the centers of outermost rows and nearer edges was 20 mm. A concrete which was prepared in composition as given in Table 1 was charged into the asphalt coated steel tube form the bottom to the top to form another test column. A concrete test piece which was made of this concrete and which had a 100 mm diameter and a 200 mm height had a cylinder strength of 420 Kg/cm² and Young's modulus of $2.94\times10^5$ Kg/cm². The test column was cured for 4 weeks and then the steel tube column thus prepared was horizontally held at its opposite ends and a constant axial force of 102 metric tons was applied to its one end of the concrete core while the other end is held stationary. Under these conditions, static loads P were applied at positions, which were spaced ¼ of the steel tube length 2L from the opposite ends, in opposite vertical directions as shown in FIG. 53. A hysteresis loop obtained is plotted in FIG. 54, where the angle R is an angle of the axis of the steel tube with the horizontal plane in term of radian and the moment M=P.L/4.

TABLE 2

| | Slit tube piece | (mm) Steel tube members |
|---|---|---|
| Outer diameter | 216 | 216 |
| Length | 120 | 1340 |
| Thickness | 12 | 8.2 |

What is claimed is:

1. A structural filler filled steel tube column, comprising:

(a) an axially extending steel tube having an inner face and including upper and lower tube sections;

(b) a core made from the structural filler disposed within the steel tube;

(c) a first separating layer, interposed between the inner face of the steel tube and the core, for separating the core from the inner face of the steel tube so that the steel tube is unbonded to the core;

(d) the upper and lower tube sections being axially spaced apart and forming an axial gap therebetween, said axial gap circumferentially extending completely around the steel tube and comprising axial stress reducing means, said gap having a variable axial length and being adapted to reduce said axial length when the steel tube is axially displaced due to an axial load applied thereto;

(e) a cylindrical member axially extending completely between the upper and lower tube sections and radially disposed between the core and the gap, said cylindrical member forming an inside closure for said gap and maintaining the core separated from the gap while permitting axial movement of the upper tube section relative to the lower tube section; and (f) axial load transmitting means, mounted to the steel tube, for transmitting the axial load, applied to the steel tube, to the core.

2. A structural filler filled steel tube column, comprising:

a steel tube having an inner face;

a core made from the structural filler disposed within the steel tube;

a first separating layer, interposed between the inner face of the steel tube and the core, for separating the core from the inner face of the steel tube so that the steel tube is unbonded to the core;

axial stress reducing means formed in the steel tube and including an annular portion circumferentially extending completely around the steel tube for reducing axial stresses which develop in the steel tube; and axial load transmitting means, mounted to the steel tube, for transmitting an axial load, applied to the steel tube, to the core;

wherein said steel tube comprises (i) a pair of tube pieces coaxially aligned with adjacent ends thereof spaced apart so that a ring-shaped gap, having an axial width, is formed between the adjacent ends of said tube pieces, said axial stress reducing means including the gap, whereby the axial stress in the steel tube is reduced by varying the axial width of the gap when the steel tube is subjected to an axial load, and (ii) means for coupling said tube pieces coaxially in series while allowing the tube pieces to be axially movable in relation to each other;

wherein each of said tube pieces has an inner face, and wherein said coupling means comprises a joining tube having a first and second end portions, said first end portion being coaxially joined to the inner face of one of the tube pieces, the second end portion fitting coaxially to the inner face of the other tube piece so that the joining tube is axially slidable in relation to the other tube piece.

3. A column as recited in claim 2, wherein said axial load transmitting means comprises an inner flange circumferentially joined to one of the opposite ends of said joining tube to project radially inwards.

4. A column as recited in claim 3, wherein said joining tube has an upper end and wherein said coupling means comprises a pliant member being axially pliant, said pliant member circumferentially disposed on the upper end of the joining tube for reducing an axial compressive load exerted from said core to said joining tube.

5. A column as recited in claims 2, 3 or 4, wherein said steel tube further comprises means for fastening said tube pieces to each other while allowing the tube pieces to approach each other but preventing the tube pieces from going away from each other, said fastening means comprising: a pair of outer flanges circumferentially joined to the adjacent ends of the tube pieces respectively, said outer flanges project radially outwards and face each other, each of the outer flanges having an inner facing surface and an outer surface; and a plurality of engaging members, each having opposite end portions, said opposite end portions being in direct contact with the outer surfaces of said outer flanges respectively.

6. A column according to claim 5, wherein each of the engaging members comprises:

a threaded rod having first and second opposite ends, and extending through each of the outer flanges;

a first nut mounted on the first end of the threaded rod and held thereon against the outer surface of a first of the outer flanges; and a second nut mounted on the second end of the threaded rod and held thereon against the outer surface of a second of the outer flanges.

7. A structural filler filled steel tube column, comprising:

a steel tube having an inner face;

a core made from the structural filler disposed within the steel tube;

a first separating layer, interposed between the inner face of the steel tube and the core, for separating the core from the inner face of the steel tube so that the steel tube is unbonded to the core;

axial stress reducing means formed in the steel tube and including an annular portion circumferentially extending completely around the steel tube for reducing axial stresses which develop in the steel tube, the annular portion having a variable vertical length and being adapted to reduce the vertical length thereof when the steel tube is vertically displaced due to an axial load applied thereto; and axial load transmitting means, mounted to the steel tube, for transmitting an axial load, applied to the steel tube, to the core; and a joint tube, coaxially mounted to at least one end of the steel tube, for joining beams thereto, the joint tube having an axis wherein the joint tube has inner circumferential faces tapering toward the axis, and wherein the axial load transmitting means comprises the inner circumferential faces of the joint tube.

8. A column as recited in claim 7, wherein the joint tube has an upper end and a lower end, each end having an inner edge, wherein the joint tube has a central portion having a thickness larger than the thickness of the steel tube, wherein the circumferential tapering faces are provided at respective inner edges of upper and lower ends so that the circumferential faces taper upwards at the lower end and downwards at the upper end, and wherein each of the upper end and the lower end is substantially equal in thickness to the steel tube.

* * * * *

UNITED STATES PATENT AND TRADEMARK OFFICE

CERTIFICATE OF CORRECTION

PATENT NO. : 5,012,622

DATED : May 7, 1991

INVENTOR(S) : Takanori Sato, et al.

It is certified that error appears in the above-identified patent and that said Letters Patent is hereby corrected as shown below:

Column 1, line 9: "889,549" should read as --899,549--

Column 9, line 28: delete "30"

Columns 22 & 23, lines 64-68 and lines 1-9: delete Claim 5 and insert the following:

--A structural filler filled steel tube column, comprising:

(a) a steel tube having an inner face;

(b) a core made from the structural filler disposed within the steel tube;

(c) a first separating layer, interposed between the inner face of the steel tube and the core, for separating the core from the inner face of the steel tube so that the steel tube is unbonded to the core;

(d) axial stress reducing means formed in the steel tube and including an annular Portion circumferentially extending completely around the steel tube for reducing axial stresses which develop in the steel tube; and (e) axial load transmitting means, mounted to the steel tube, for transmitting an axial load, applied to the steel tube to the core;

wherein said steel tube comprises;

(i) a pair of tube pieces coaxially aligned with adjacent ends thereof spaced apart so that a ring-shaped gap, having an axial width, is formed between the adjacent ends of said tube pieces, said axial stress reducing means including the It is certified that error appears in the above-identified patent and that said Letters Patent is hereby corrected as shown below:

gap, whereby the axial stress in the steel tube is reduced by varying the axial width of the gap when the steel tube is subjected to an axial load, ii) means for coupling said tube pieces coaxially in series while allowing the tube pieces to be axially movable in relation to each other, and iii) means for fastening said tube pieces to each other while allowing the tube pieces to approach each other but preventing the tube pieces from going away from each other, said fastening means comprising; a pair of outer flanges circumferentially joined to the adjacent ends of the tube pieces respectively, said outer flanges project radially outwards and face each other, each of the outer flanges having an inner facing surface and an outer surface; and a plurality of engaging members, each having opposite end portions, said opposite end portions being in direct contact with the outer surfaces of said outer flanges respectively,

UNITED STATES PATENT AND TRADEMARK OFFICE

CERTIFICATE OF CORRECTION

PATENT NO. : 5,012,622

DATED : May 7, 1991

INVENTOR(S) : Takanori Sato, et al

It is certified that error appears in the above-identified patent and that said Letters Patent is hereby corrected as shown below:

wherein each of said tube pieces has an inner face, and wherein said coupling means comprises a joining tube having a first and second end portions, said first end portion being coaxially joined to the inner face of one of the tube pieces, the second end portion fitting coaxially to the inner face of the other tube piece so that the joining tube is axially slidable in relation to the other tube piece.--

Signed and Sealed this

Sixteenth Day of November, 1993

*Attest:*

Bruce Lehman

BRUCE LEHMAN

*Attesting Officer*

*Commissioner of Patents and Trademarks*